US008162306B2

(12) United States Patent
Suzuki et al.

(10) Patent No.: US 8,162,306 B2
(45) Date of Patent: Apr. 24, 2012

(54) SHEET ALIGNING APPARATUS, SHEET PROCESSING APPARATUS, AND IMAGE FORMING APPARATUS

(75) Inventors: Nobuyoshi Suzuki, Tokyo (JP); Masahiro Tamura, Kanagawa (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Hitoshi Hattori, Tokyo (JP); Junichi Tokita, Kanagawa (JP); Takashi Saito, Kanagawa (JP); Akira Kunieda, Tokyo (JP); Ichiro Ichihashi, Aichi (JP); Atsushi Kuriyama, Aichi (JP); Hiroshi Maeda, Gifu (JP)

(73) Assignee: Ricoh Company, Limited, Tokyo (JP)

( * ) Notice: Subject to any disclaimer, the term of this patent is extended or adjusted under 35 U.S.C. 154(b) by 230 days.

(21) Appl. No.: 12/654,097

(22) Filed: Dec. 10, 2009

(65) Prior Publication Data

US 2010/0148417 A1 Jun. 17, 2010

(30) Foreign Application Priority Data

Dec. 12, 2008 (JP) ..... 2008-317313

(51) Int. Cl.
*B65H 37/04* (2006.01)

(52) U.S. Cl. ..... 270/58.12; 270/58.16; 270/58.17; 271/193

(58) Field of Classification Search ..... 270/58.08, 270/58.11, 58.12, 58.16, 58.17; 271/193
See application file for complete search history.

(56) References Cited

U.S. PATENT DOCUMENTS

| | | | | |
|---|---|---|---|---|
| 7,300,052 | B2 * | 11/2007 | Tamura et al. | 271/221 |
| 7,416,177 | B2 | 8/2008 | Suzuki | |
| 7,568,688 | B2 * | 8/2009 | Nomura et al. | 270/58.12 |
| 7,673,867 | B2 * | 3/2010 | Keny et al. | 270/58.12 |
| 7,862,026 | B2 * | 1/2011 | Terao et al. | 270/58.12 |
| 2002/0109283 | A1 * | 8/2002 | Hasegawa et al. | 270/58.08 |
| 2006/0071410 | A1 * | 4/2006 | Koie | 271/207 |
| 2008/0067730 | A1 | 3/2008 | Suzuki | |
| 2008/0211162 | A1 | 9/2008 | Suzuki | |
| 2009/0066003 | A1 | 3/2009 | Kunieda | |

FOREIGN PATENT DOCUMENTS

| | | |
|---|---|---|
| JP | 06-016318 | 1/1994 |
| JP | 3401937 | 2/2003 |
| JP | 3644536 | 2/2005 |
| JP | 3648073 | 2/2005 |
| JP | 2008-001478 | 1/2008 |

OTHER PUBLICATIONS

Abstract of JP 2002-114433, Apr. 16, 2002.
Abstract of JP 2000-086056, Mar. 27, 2000.
Abstract of JP 08-073111, Mar. 19, 1996.

* cited by examiner

*Primary Examiner* — Patrick Mackey
(74) *Attorney, Agent, or Firm* — Harness, Dickey & Pierce, P.L.C.

(57) ABSTRACT

A sheet aligning apparatus includes an alignment surface formed in a planar shape and that presses an end of a sheet to move and align the sheet; and a holding unit that holds the end of the sheet at a position contacting the alignment surface in a state that a curled end of the sheet contacts the alignment surface and the sheet is thus pressed.

16 Claims, 24 Drawing Sheets

SHEET ALIGNING APPARATUS, SHEET PROCESSING APPARATUS, AND IMAGE FORMING APPARATUS

CROSS-REFERENCE TO RELATED APPLICATIONS

The present application claims priority to and incorporates by reference the entire contents of Japanese Patent Application No. 2008-317313 filed in Japan on Dec. 12, 2008.

BACKGROUND OF THE INVENTION

1. Field of the Invention

The present invention relates to a sheet aligning apparatus that aligns sheet-like recording media (hereinafter, "sheets") carried thereto such as recording paper and overhead projector (OHP) sheets; a sheet processing apparatus that includes the sheet aligning apparatus and performs predetermined processing such as sorting, stacking, binding, folding, and punching to the sheets; and an image forming apparatus that integrally or separately includes the sheet processing apparatus.

2. Description of the Related Art

A sheet post-processing apparatus performs post-processing in, for example, the following steps. That is, sequentially receiving sheets from an image forming apparatus; aligning the sheets into a sheet bundle composed of a plurality of sheets; and automatically binding, or aligning punched sheets as the sheet bundle and sorting the bundle per unit. The post-processing apparatus is a so-called finisher. Although such a sheet post-processing apparatus can handle various types of sheets, if the sheets are soft sheets (paper) or curled sheets, the sheets cannot be surely moved by pressing of a wall surface of an aligning unit.

FIGS. 31A, 31B, and 31C are exemplary diagrams of a conventional general sheet aligning apparatus. FIG. 31A is a diagram of a state where a sheet Sn (an uppermost paper) is newly discharged on a sheet bundle S on an alignment tray 600. Assume that as shown in FIG. 31A, both ends of the sheet Sn are curled. In this state, when a movable jogger 602 moves and presses an end of the sheet Sn, an edge surface a of the sheet slides up as illustrated in FIG. 31B. Thus, when the jogger 102 moves further and reaches the side surface of the sheet bundle S, the sheet Sn does not move therealong. When the jogger 102 returns to its home position as illustrated in FIG. 31C, the edge surface a returns to the state of FIG. 31A. Thus, the sheet Sn is unmoved, and therefore, the sheet is not aligned. This happens not only when the sheet is curled but also when the sheet is soft. When the jogger presses the end of the soft sheet, the end of the sheet gets buckled and thus the sheet is not moved. The sheet may be moved for a small distance before buckling but in that case, the sheet is aligned only by the small distance before buckling, resulting in an incomplete alignment.

The edge surface refers to a cut surface sheet bundle that is formed when a large size sheet bundle is cut to create a small size sheet bundle. The edge surface a corresponds to an end in the longitudinal direction of the sheet and a side in the lateral direction. In this specification, the edge surface is referred to as an end or a side.

A sheet processing apparatus for processing sheets of curled paper and soft paper is disclosed in, for example, Japanese Patent Application Laid-open No. 6-016318 or Japanese Patent No. 3648073.

Japanese Patent Application Laid-open No. 6-016318 discloses a sheet processing apparatus that includes a sheet mounting unit and a pair of sheet side regulation side plates provided on both sides of the sheet on the sheet mounting unit. The sheet mounting unit stores therein or discharges and stacks thereon the sheets. At least one of the sheet side regulation side plates is movable in directions of narrowing and widening the distance to another plate. With the movement, the sheet on the sheet mounting unit is moved to be positioned between the plates, whereby the sheet is aligned. At a contact surface of the sheet side regulation side plate contacting a side end of the sheet in the post-processing apparatus, the friction to the sheet is made to be small in a direction from up to down and to be large in a direction from down to up. As a result, the curled sheet can be appropriately aligned. To provide the large friction, hair implantation sloping downward or saw-toothed concavity and convexity forming are performed.

Japanese Patent No. 3648073 discloses a sheet processing apparatus that teaches processing a holding surface of a pusher mechanism holding the lower end of the sheet so that the lower end of the sheet easily moves in the sheet pressed direction but does not easily return in the opposite direction, thereby preventing the pressed and aligned sheet from moving on the holding surface of the pusher mechanism.

The conventional techniques prevent the edge surface of the sheet from sliding to align the sheet by forming concavity and convexity on the wall surface of the jogger or adjusting a hair implant direction. However, the alignment accuracy of the jogger is affected by the concavity and convexity as a shape of the wall surface or due to hair implantation, and concavity and convexity along the concavity and the convexity are generated on the side surface of the aligned sheet bundle. As a result, the sheet cannot be accurately aligned unlike counterparts aligned by a planer wall surface.

SUMMARY OF THE INVENTION

It is an object of the present invention to at least partially solve the problems in the conventional technology.

According to an aspect of the present invention, there is provided a sheet aligning apparatus including an alignment surface formed in a planar shape and that presses an end of a sheet to move and align the sheet; and a holding unit that holds the end of the sheet at a position contacting the alignment surface in a state that a curled end of the sheet contacts the alignment surface and the sheet is thus pressed.

According to another aspect of the present invention, there is provided a sheet processing apparatus including an alignment tray for staking sheets thereon received from a carrying direction; a first aligning device that includes a first lateral direction aligning unit that aligns sheets stacked on the alignment tray in a width direction orthogonal to a carrying direction and a first longitudinal direction aligning unit that aligns the sheets in the carrying direction thereby obtained a first-aligned sheet bundle; a first processing device that performs predetermined processing to the first-aligned sheet bundle stacked on the alignment tray thereby obtaining a first-processed sheet bundle; and a first bundle transporting unit that transports the first-processed sheet bundle on the alignment tray downstream. The first lateral direction aligning unit, the first longitudinal direction aligning unit, and the first bundle transporting unit have respective planer contact surfaces to which a curled end of a sheet contacts, and at least one contact surface of the first lateral direction aligning unit, the first longitudinal direction aligning unit, and the first bundle transporting unit comprises a holding unit that holds the curled end at a position contacting the end of the sheet.

According to still another aspect of the present invention, there is provided an image forming apparatus comprising an image forming unit and a sheet processing apparatus that processes printed sheets received from the image forming unit. The sheet processing apparatus including an alignment tray for staking sheets thereon received from a carrying direction from the image forming unit; a first aligning device that includes a first lateral direction aligning unit that aligns sheets stacked on the alignment tray in a width direction orthogonal to a carrying direction and a first longitudinal direction aligning unit that aligns the sheets in the carrying direction thereby obtained a first-aligned sheet bundle; a first processing device that performs predetermined processing to the first-aligned sheet bundle stacked on the alignment tray thereby obtaining a first-processed sheet bundle; and a first bundle transporting unit that transports the first-processed sheet bundle on the alignment tray downstream. The first lateral direction aligning unit, the first longitudinal direction aligning unit, and the first bundle transporting unit have respective planer contact surfaces to which a curled end of a sheet contacts, and at least one contact surface of the first lateral direction aligning unit, the first longitudinal direction aligning unit, and the first bundle transporting unit comprises a holding unit that holds the curled end at a position contacting the end of the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described below with reference to the accompanying drawings.

1. The Whole Structure

Figure 1:
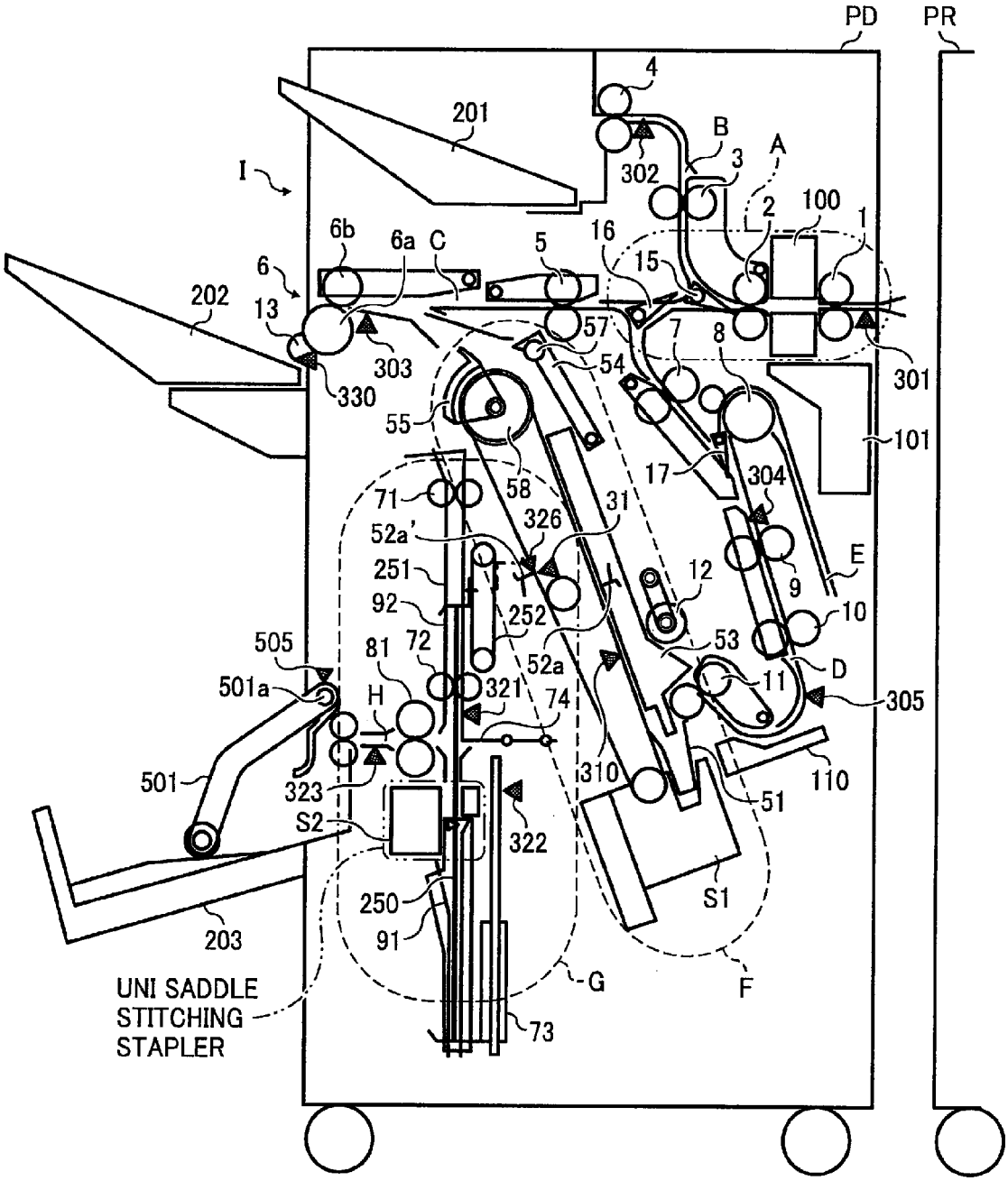
FIG. 1 is a diagram of a system structure of an image processing system including a sheet processing apparatus that primarily illustrates a sheet post-processing apparatus according to an embodiment of the present invention, and an image forming apparatus.

FIG. 1 is a diagram of a system structure of an image forming system. The image forming system includes a sheet post-processing apparatus PD as a sheet processing apparatus according to an embodiment of the present invention and an image forming apparatus PR. The sheet post-processing apparatus PD is illustrated in its entirety in FIG. 1 while only a portion of the image forming apparatus PR is illustrated in FIG. 1.

As shown in FIG. 1, the sheet post-processing apparatus PD is mounted on a side of the image forming apparatus PR. A recording medium (i.e., a sheet) discharged from the image forming apparatus PR is guided to the sheet post-processing apparatus PD. The sheet passes a carrying passage A having a post-processing unit (a punching unit 100 in this embodiment) that performs post-processing on a single sheet. Then by the actions of branching claws 15 and 16, the sheet is distributed to one of carrying passages B, C, and D. The carrying passage B guides the sheet to an upper tray 201; the carrying passage C guides the sheet to a shift tray 202; and the carrying passage D guides the sheet to a processing tray F (also referred to as a edge surface stitching tray) that performs alignment and staple binding. In the following explanation, the reference character Sn of a sheet and the reference character S of a sheet bundle are appropriately omitted for avoiding complexity.

Although not shown specifically in the diagram, the image forming apparatus PR includes an image processing circuit that converts input image data into printable image data, an optical writing device that performs optical writing to a photoreceptor based on an image signal output from the image processing circuit, a developing device that performs toner developing on a latent image formed by the optical writing on the photoreceptor, a transcription device that transcribes a toner image developed by the developing apparatus to a sheet, and a fixing apparatus that fixes the toner image transcribed on a sheet. The image forming apparatus PR feeds out the sheet on which a toner image is fixed to the sheet post-processing apparatus PD. The sheet post-processing apparatus PD performs certain post-processing on the sheet. As is apparent from the above description, the image forming apparatus PR herein is an electrophotographic system. Instead, all known image forming apparatuses such as an inkjet system and a thermal transfer system can be used. In this embodiment, an image forming unit includes the image processing circuit, the optical writing device, the developing device, the transcription device, and the fixing device.

The sheet is guided to the edge surface stitching tray F through the carrying passages A and D to be, for example, aligned and stapled. After that, a branching guide plate 54 and a movable guide 55 as deviating units distribute the sheet to: the carrying passage C that guides the sheet to the shift tray 202; or to a processing tray G (also referred to as a saddle stitching and saddle folding tray) that performs folding, for example. The sheet folded, for example, in the saddle stitching and saddle folding tray G is guided to a lower tray 203 through a carrying passage H. A branching claw 17 is arranged in the carrying passage D and held in a state of FIG. 1 by a low load spring not shown. After the rear end of the sheet passes through the branching claw 17, at least a carrying roller 9, among carrying rollers 9 and 10 and a staple paper discharging roller 11, is reversed and a pre-stack roller 8 guides the rear end of the sheet to a sheet storing unit E. The sheet may stay there so as to be carried with the next sheet stacked thereon. Thus, two or more sheets overlapped with each other can be carried by repeating the operation. The reference numeral 304 is a pre-stack sensor for setting the timing of backward carrying upon pre-stacking the sheets.

In the carrying passage A in the upstream of the carrying passages B, C, and D and commonly connected thereto, an entrance sensor 301 that detects a sheet carried from the image forming apparatus PR, an entrance roller 1, a punching unit 100, a punching dust hopper 101, a carrying roller 2, the branching claws 15 and 16 are arranged in this order. The branching claws 15 and 16 are held in a state of FIG. 1 by a spring not shown. The branching claws 15 and 16 are operated by not shown solenoids. By turning on a solenoid corresponding to the branching claw 15, the branching claw 15 is rotated upward and by turning on a solenoid corresponding to the branching claw 16 the branching claw 16 is rotated downward to distribute the sheets to the carrying passage B, the carrying passage C, or the carrying passage D.

To guide the sheet to the carrying passage B, the solenoids of both claws are turned off to keep the branching claws in the state of FIG. 1, and therefore, the sheet is discharged to the upper tray 201 through a carrying roller 3 and a paper discharging roller 4. To guide the sheet to the carrying passage C, the solenoids of both claws are turned on from the state of FIG. 1. Accordingly, the branching claw 15 rotates upward and the branching claw 16 rotates downward, and therefore, the sheet is carried to the shift tray side 202 through a carrying roller 5 and a pair of shift paper discharging rollers 6 (6*a* and 6*b*). To guide the sheet to the carrying passage D, the solenoid of the branching claw 16 is turned off so that the branching claw 16 is kept in the state of FIG. 1, while the solenoid of the branching claw 15 is turned on so that the branching claw 16 is rotated upward from the state of FIG. 1.

For example, the sheet post-processing apparatus can perform the following processing on a sheet: punching (by the punching unit 100); sheet alignment and end stitching (by jogger fences 53 and an edge surface stitching stapler S1); sheet alignment and saddle stitching (by the saddle stitching upper jogger fence 250*a*, the saddle stitching lower jogger fence 250*b*, and a saddle stitching stapler S2); sheet sorting (by the shift tray 202); and saddle folding (by a folding plate 74 and a folding roller 81).

2. Shift Tray

Figure 2:
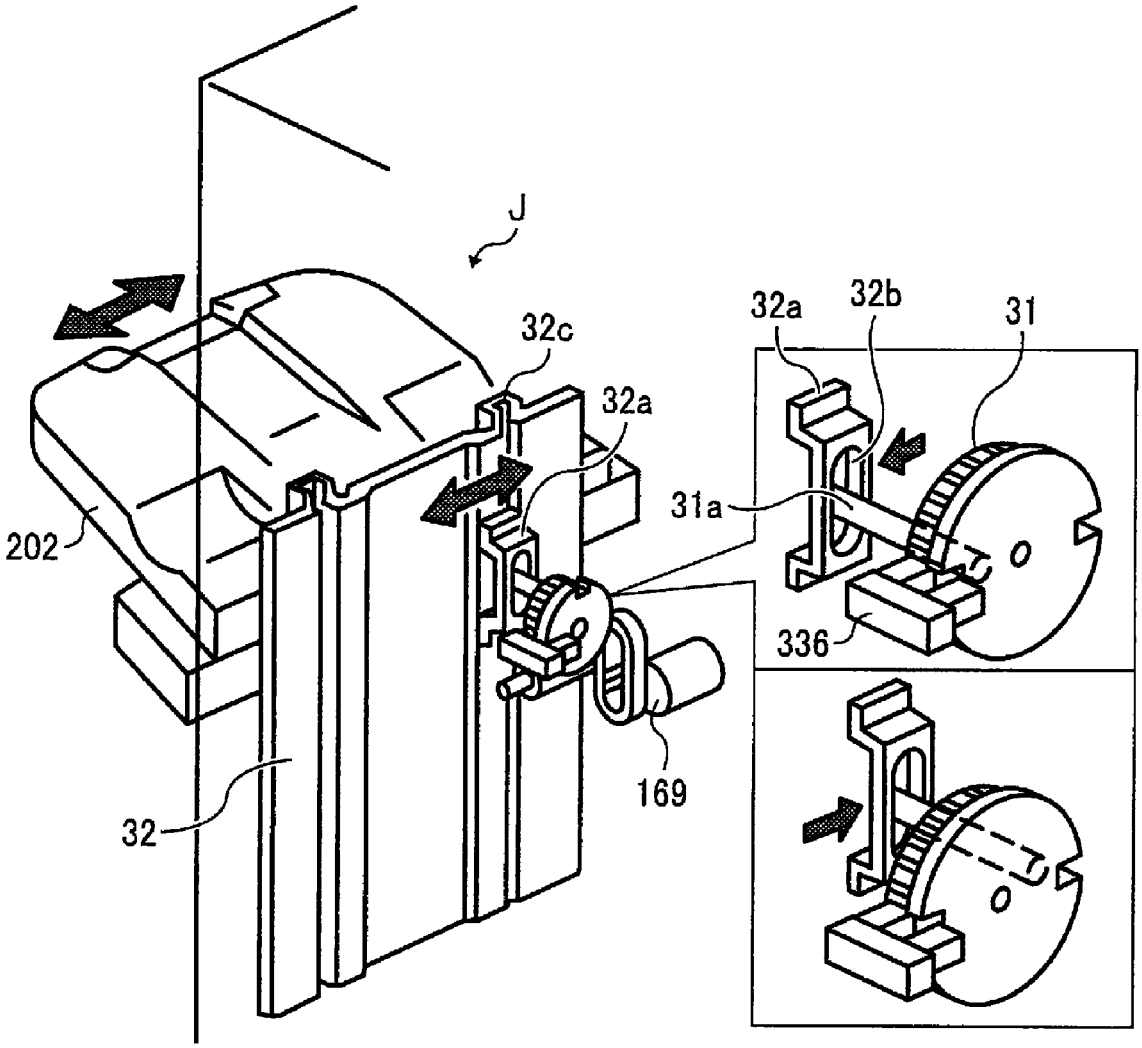
FIG. 2 is an enlarged perspective view of main components of a shift mechanism of the sheet post-processing apparatus.
Figure 3:
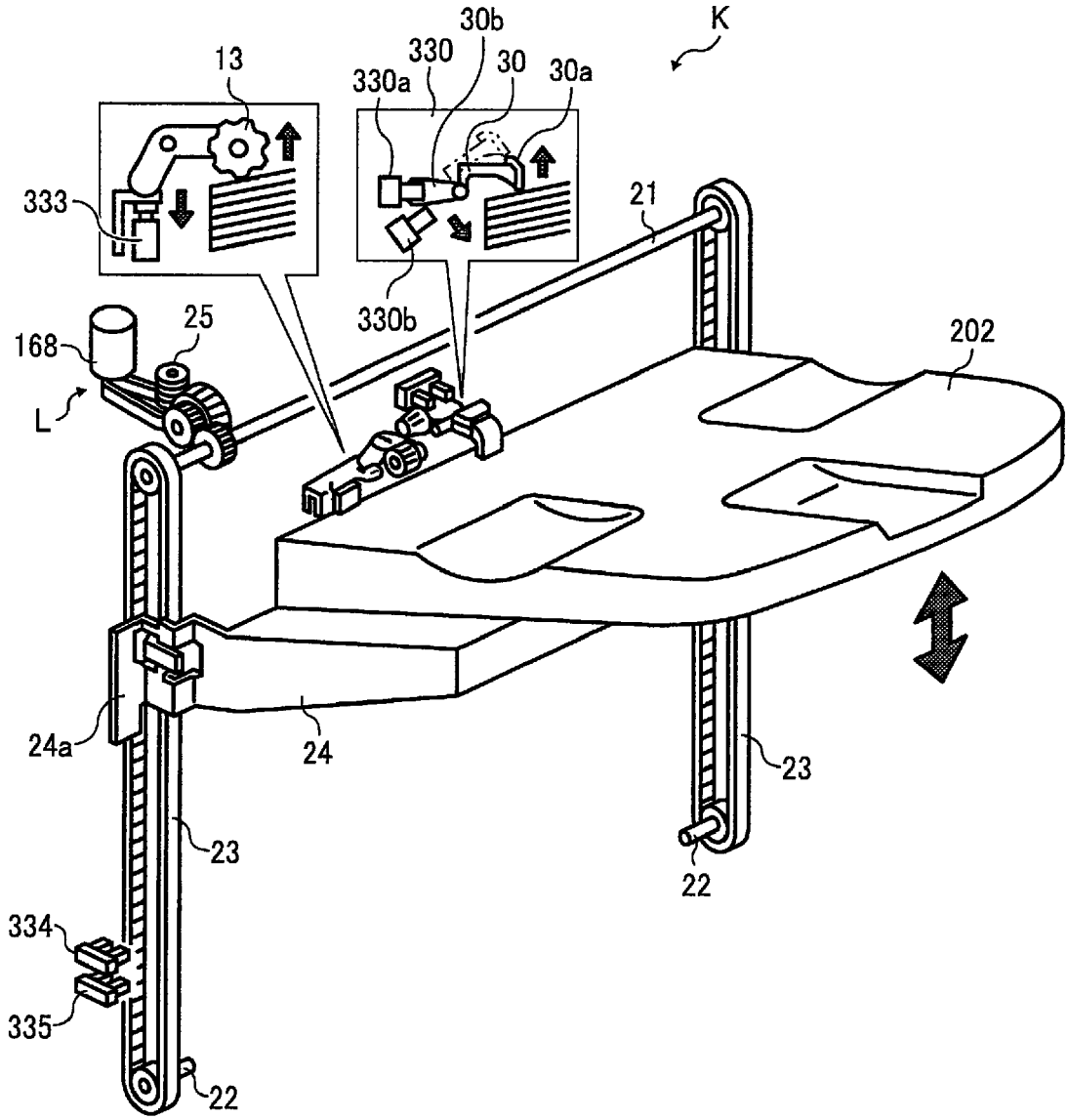
FIG. 3 is an enlarged perspective view of main components of a shift tray elevating mechanism of the sheet post-processing apparatus.

A shift tray paper discharging unit I positioned at the most downstream in the direction of conveyance of a sheet in the sheet post-processing apparatus PD includes the shift paper discharging rollers 6 (6*a* and 6*b*), a returning roller 13, a paper surface detecting sensor 330, the shift tray 202, a shifting mechanism J illustrated in FIG. 2, and a shift tray elevating mechanism K illustrated in FIG. 3. FIG. 2 is an enlarged perspective view of main components of the shifting mechanism J, and FIG. 3 is an enlarged perspective view of main components of the shift tray elevating mechanism K.

Referring to FIGS. 1 and 3, the returning roller 13 is made of sponge and contacts a sheet discharged from the shift paper discharging roller 6 to make the rear end of the sheet abut against an end fence 32 illustrated in FIG. 2, thereby aligning the sheet. The returning roller 13 rotates by rotational force from the shift paper discharging rollers 6. A tray rising limit switch 333 is provided near the returning roller 13. When the shift tray 202 rises and pushes up the returning roller 13, the tray rising limit switch 333 is turned on to stop a tray elevating motor 168. As a result, the shift tray 202 is prevented from over rising. The paper surface detecting sensor 330 as a paper surface position detecting unit that detects a paper surface position of a sheet or a sheet bundle discharged on the shift tray 202 is also provided near the returning roller 13 as illustrated in FIG. 1.

Although the detail is not shown in FIG. 1, the paper surface detecting sensor 330 includes a paper surface detecting lever 30 illustrated in FIG. 3, a paper surface detecting sensor 330*a* (for a stapled sheet), and a paper surface detecting sensor 330*b* (for a non-stapled sheet). The paper surface detecting lever 30 is provided to be rotatable about a shaft thereof, and includes: a contacting unit 30*a* that contacts a rear end upper surface of the sheet stacked on the shift tray 202; and a fan-shaped shield 30*b*. The paper surface detecting sensor 330*a* (for a stapled sheet) positioned at the upper position is mainly used for stapled paper discharging control, and the paper surface detecting sensor 330*b* (for a non-stapled sheet) is mainly used for a shift paper discharging control.

In this embodiment, the paper surface detecting sensor 330*a* (for a stapled sheet) and the paper surface detecting sensor 330*b* (for a non-stapled sheet) are turned on when being shielded by the fan-shaped shield 30*b*. Accordingly, when the shift tray 202 rises and the contacting unit 30*a* of the paper surface detecting lever 30 rotates upward, the paper surface detecting sensor 330*a* (for a stapled sheet) is turned off, and if the contacting unit 30*a* further rotates, the paper surface detecting sensor 330*b* (for a non-stapled sheet) is turned on. When the paper surface detecting sensor 330*a* (for a stapled sheet) and the paper surface detecting sensor 330*b* (for a non-stapled sheet) detect that the amount of the stacked sheets has reached a predetermined height, the tray elevating motor 168 drives the shift tray 202 to fall by a predetermined amount. Consequently, the paper surface position of the shift tray 202 is kept approximately constant.

2.1. Elevating Mechanism of a Shift Tray

The elevating mechanism of the shift tray 202 will be described in detail.

As illustrated in FIG. 3, the shift tray 202 elevates when a drive shaft 21 is driven by a driving unit L. A timing belt 23 is spanned between the drive shaft 21 and a driven shaft 22 with a tension through a timing pulley, and a side plate 24 that supports the shift tray 202 is fixed to the timing belt 23. Thus, the unit including the shift tray 202 is elevatably hung from the timing belt 23.

The driving unit L includes the tray elevating motor 168 and a worm gear 25. The power generated by the reversible tray elevating motor 168 as a drive source is transmitted to the final gear in a gear train fixed on the drive shaft 21 through the worm gear 25 to move the shift tray 202 in the vertical direction. The shift tray 202 can be held at a certain position because the power is transmitted through the worm gear 25. Thus, the shift tray 202 can be prevented from an unexpected falling accident, for example.

A shield plate 24*a* is integrally formed on the side plate 24 of the shift tray 202, and a full detecting sensor 334 that detects fill of the stacked sheets and a lower limit sensor 335 that detects a lower limit position are provided at the lower position of the shift tray 202. The full detecting sensor 334 and the lower limit sensor 335 are turned on/off by the shield plate 24*a*. The full detecting sensor 334 and the lower limit sensor 335 are photosensors that are turned on when shielded by the shield plate 24*a*. The shift paper discharging roller 6 is omitted in FIG. 3.

The swing (shift) mechanism of the shift tray 202 includes a shift motor 169 and a shift cam 31 as illustrated in FIG. 2. The shift tray reciprocates in a direction orthogonal to the paper discharging direction by rotating the shift cam 31 using the shift motor 169 as a drive source. A pin 31*a* is provided to stand from a position away from the rotating center by a predetermined amount on the shift cam 31, and the other end of the pin 31*a* freely fits a slot 32*b* of an engagement member 32*a* of the end fence 32. The engagement member 32*a* is fixed on the back surface (the surface opposite to the surface at which the shift tray 202 is positioned) of the end fence 32. According to the rotating position of the pin 31*a* of the shift cam 31, the engagement member 32*a* reciprocates in the direction orthogonal to the sheet paper discharging direction making the shift tray 202 move also in the direction orthogonal to the sheet paper discharging direction. The shift tray 202 stops at two positions: on the side closer to the reader and on the side farther from the reader in FIG. 1 (corresponding to the enlarged view of the shift cam 31 in FIG. 2). A shift sensor 336 detects a notch of the shift cam 31, and the shift motor 169 is turned on or off based on the detected signal, and thus the stop control is performed.

Figure 4:
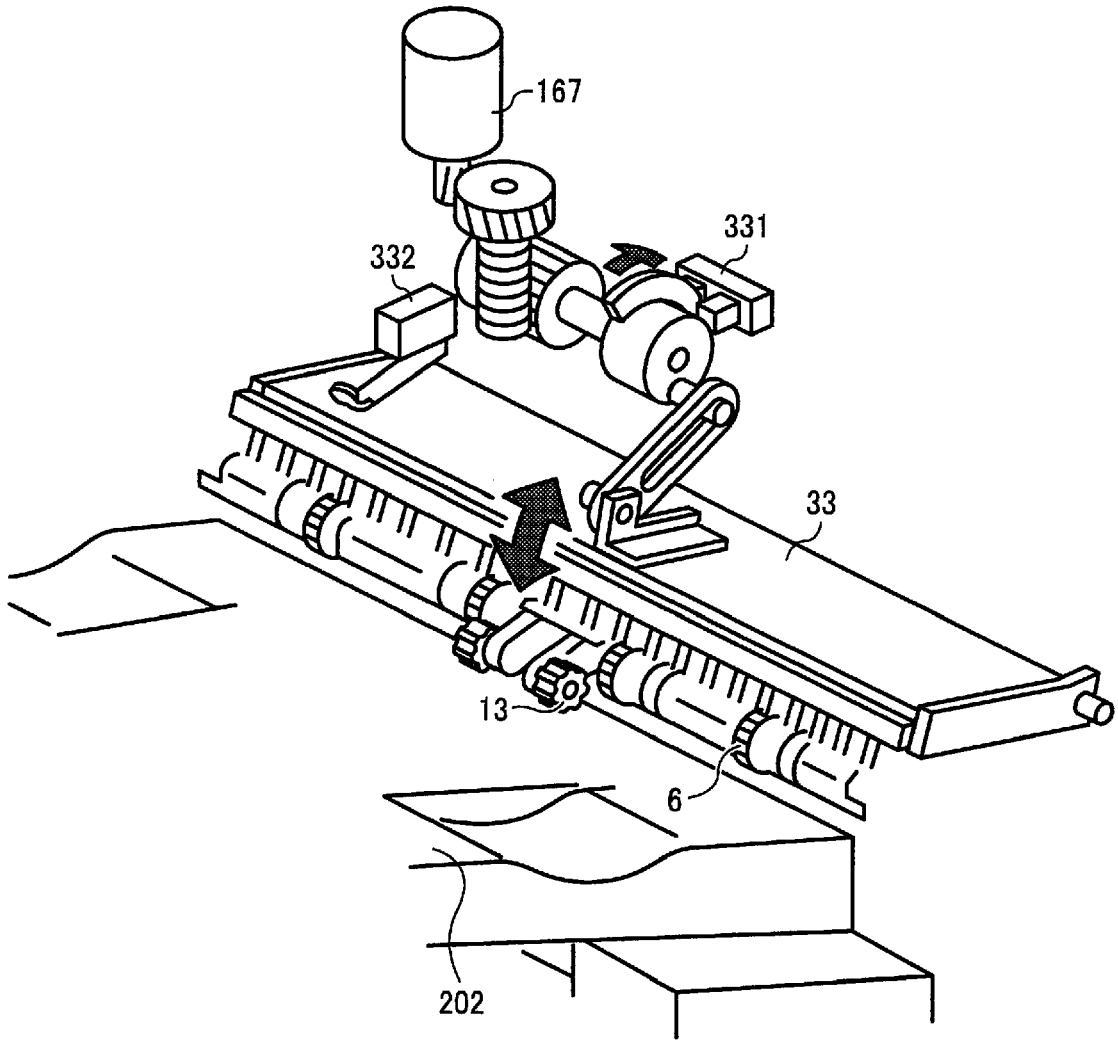
FIG. 4 is a perspective view of a configuration of a paper discharging unit of the sheet post-processing apparatus that discharges paper to a shift tray.

The shift paper discharging roller 6 has a drive roller 6*a* and a driven roller 6*b*. As illustrated in FIGS. 1 and 4, the driven roller 6*b* is rotatably supported by a free end of an open/close guide plate 33 whose upstream end in the sheet discharging direction is supported so as to be rotatable in the vertical direction. The driven roller 6*b* contacts the drive roller 6*a* by own weight or urging force, and the sheet is pinched between both rollers and discharged. When discharging a bound sheet bundle, the open/close guide plate 33 rotated upward to a stop position and returns to the original position at a predetermined timing determined based on a detected signal of a shift paper discharging sensor 303. The stop position is determined based on a detected signal of a paper discharging guide plate open/close sensor 331. The open/close guide plate 33 is driven by a paper discharging guide plate open/close motor 167.

A projection 32*c* for guiding the shift tray 202 is provided on the front surface side of the end fence 32. The rear end of the shift tray 202 freely fits the projection 32*c* so as to be movable in the vertical direction. Accordingly, the shift tray 202 is supported by the end fence 32 so as to be movable in the vertical direction and be reciprocatable in the direction orthogonal to the sheet carrying direction. The end fence 32 guides the rear end of the stacked paper on the shift tray 202 to align the rear end of the paper.

2.2. Paper Discharging Unit

FIG. 4 is a perspective view of a configuration of a paper discharging unit that discharges paper to the shift tray 202.

Referring to FIGS. 1 and 4, the shift paper discharging roller 6 has the drive roller 6*a* and the driven roller 6*b*. The driven roller 6*b* is rotatably supported by the free end of the open/close guide plate 33 whose upstream end in the sheet discharging direction is supported so as to be swingable in the vertical direction. The driven roller 6*b* contacts the drive roller 6*a* by own weight or urging force, and the sheet is pinched between both rollers 6*a* and 6*b* and discharged. When discharging a bound sheet bundle, the open/close guide plate 33 is raised to a stop position and then returns to the original position at a predetermined timing determined based on the detected signal of the shift paper discharging sensor 303. The stop position is determined based on the detected signal of the paper discharging guide plate open/close sensor 331 that is driven by the paper discharging guide plate open/close motor 167. The paper discharging guide plate open/close motor 167 is driven by turning on/off of a paper discharging guide plate open/close limit switch 332.

3. Edge Surface Stitching Tray 3.1. The Whole Structure of an Edge Surface Stitching Tray The structure of the edge surface stitching tray F that performs staple processing will be described in detail.

Figure 5:
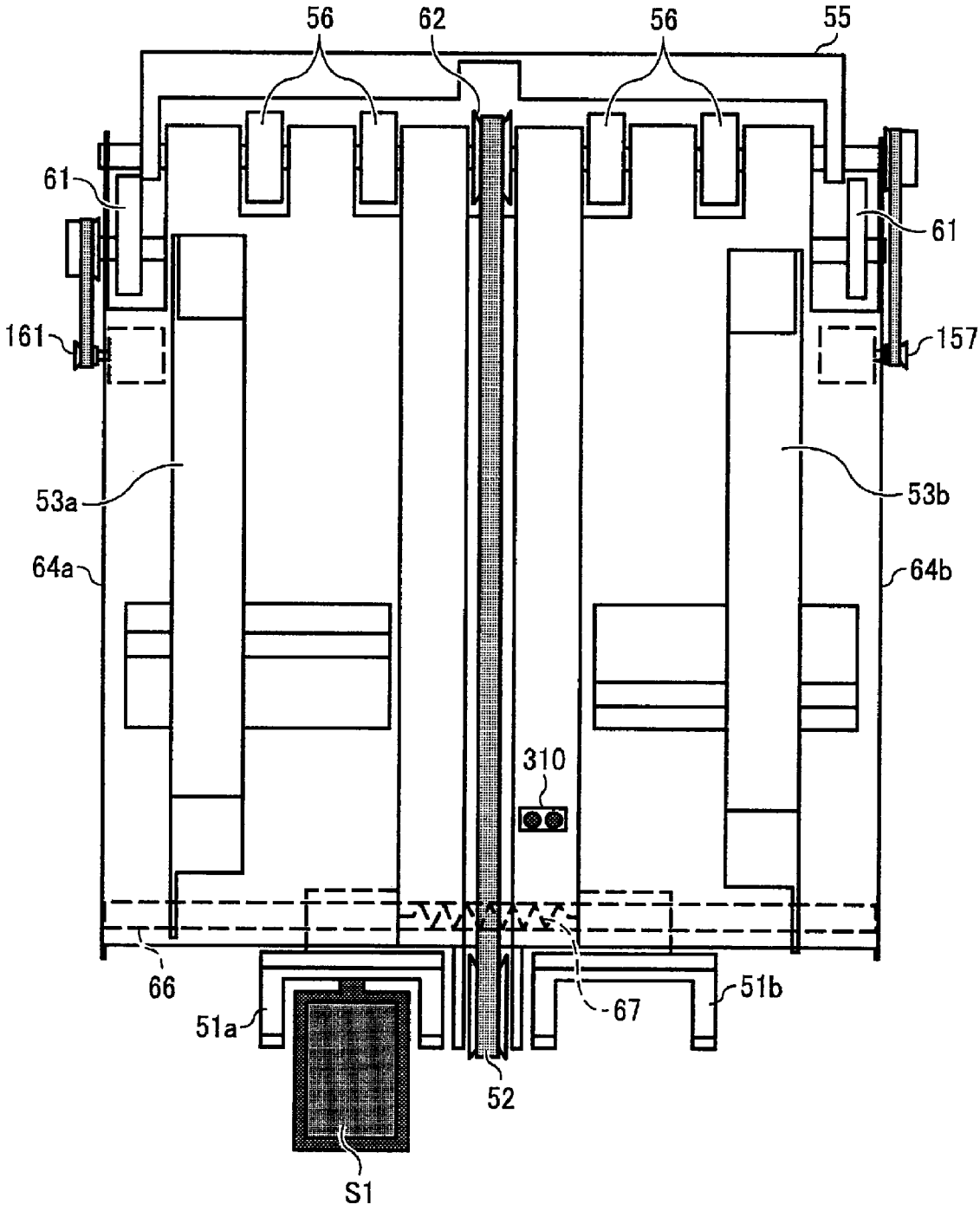
FIG. 5 is a plane view of an edge surface stitching tray of the sheet post-processing apparatus viewed from a direction perpendicular to a sheet carrying surface.
Figure 6A:
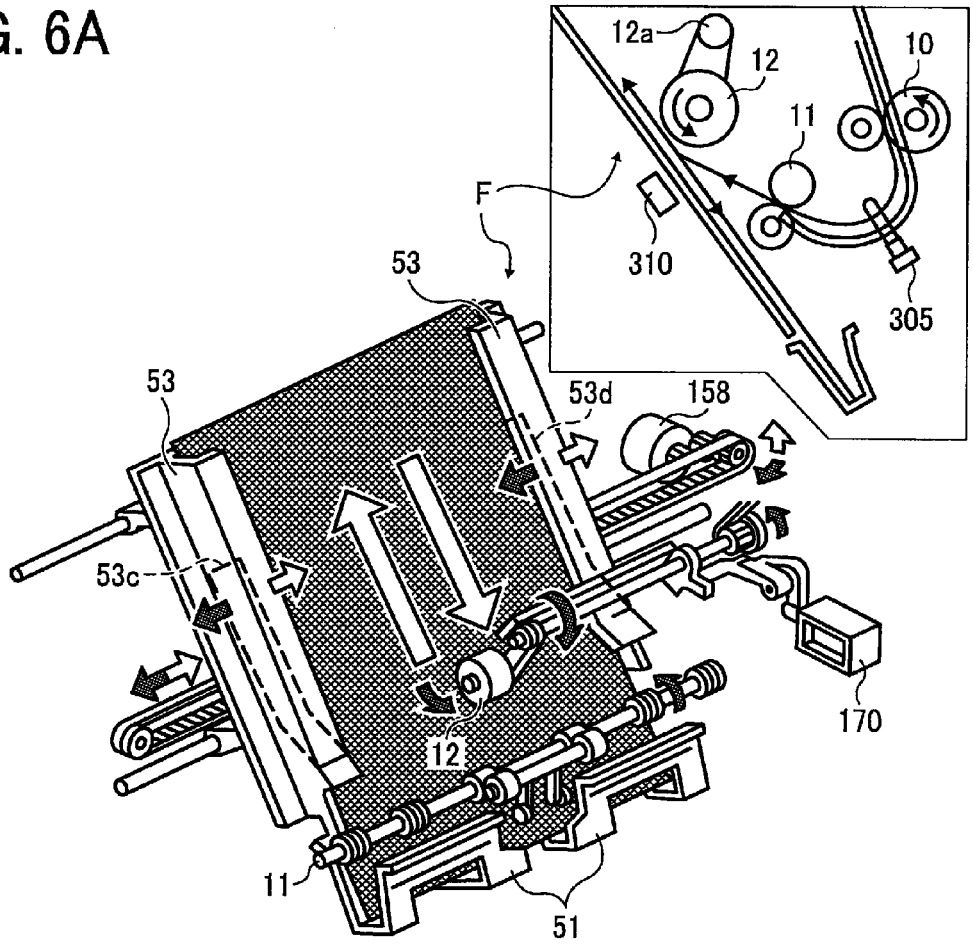
FIG. 6A is a perspective view of the edge surface stitching tray of the sheet post-processing apparatus and a drive mechanism thereof.
Figure 6B:
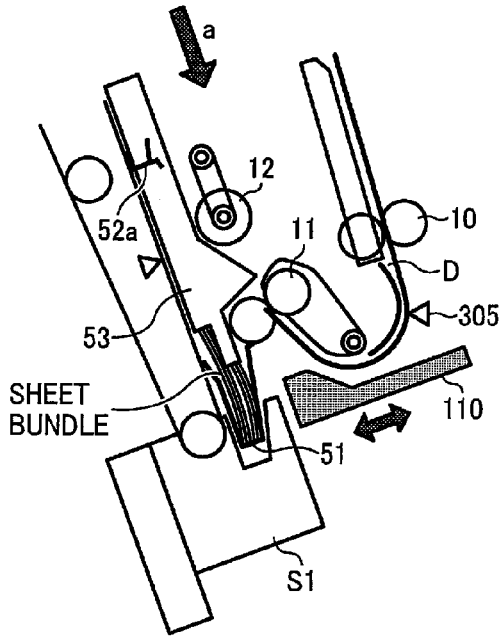
FIG. 6B is a schematic front view of a rear end pressing mechanism.
Figure 6C:
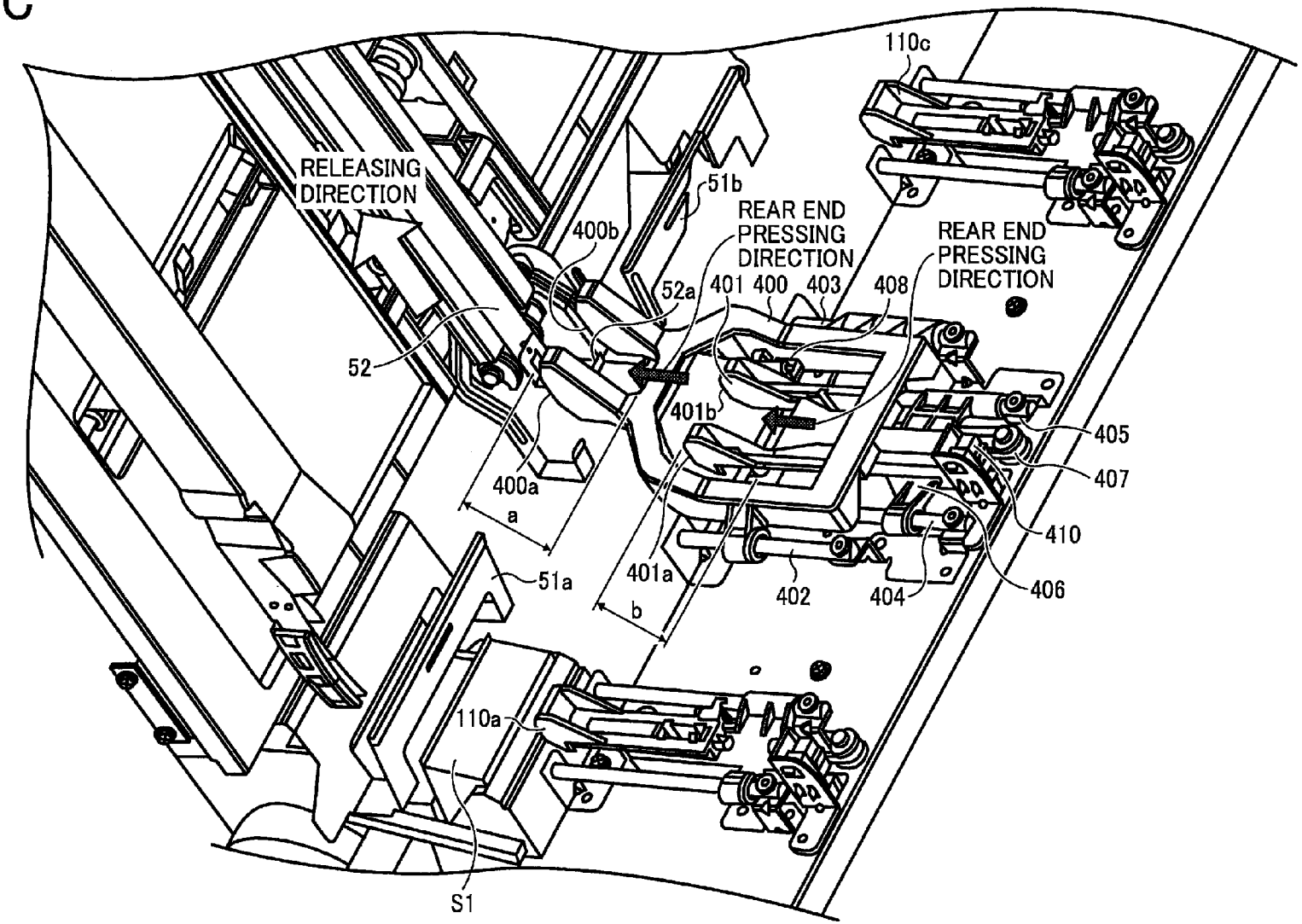
FIG. 6C is a perspective view of main components of the rear end pressing mechanism in detail.
Figure 7:
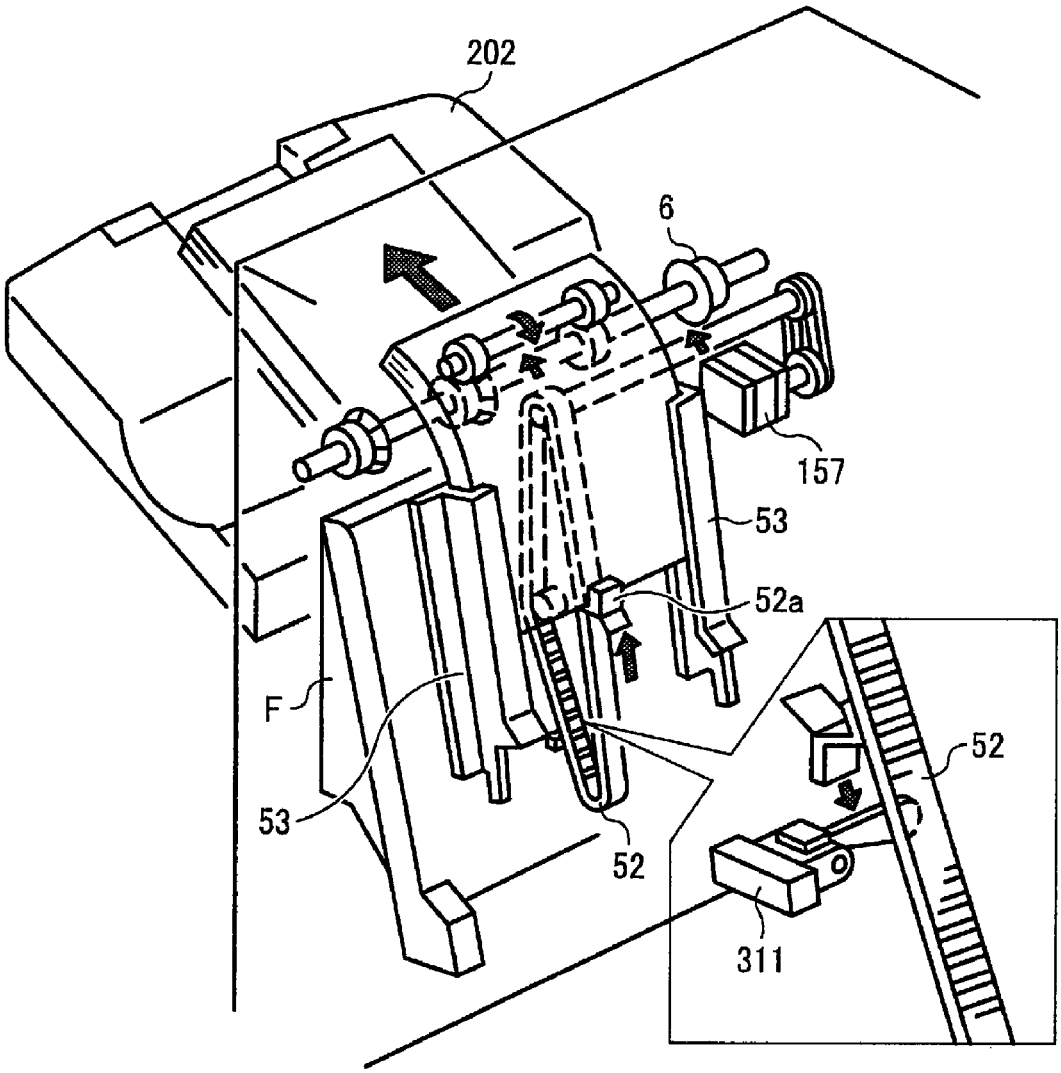
FIG. 7 is a perspective view of a releasing mechanism of the sheet post-processing apparatus that releases a sheet bundle.

FIG. 5 is a plane view of the edge surface stitching tray F viewed from a direction perpendicular to a sheet carrying surface, FIG. 6A is a perspective view of the edge surface stitching tray F and the driving mechanism thereof, FIG. 6B is a front view of the outline of the rear end pressing mechanism, FIG. 6C is a perspective view of main components of the rear end pressing mechanism, and FIG. 7 is a perspective view of a sheet bundle discharging mechanism.

As illustrated in FIG. 6A, the sheets are guided to the edge surface stitching tray F by the staple paper discharging roller 11 and subsequently stacked on the edge surface stitching tray F. In this case, the alignment in the longitudinal direction (the sheet carrying direction) is performed for every sheet by a tapping roller 12, and the alignment in the lateral direction (the direction orthogonal to the sheet carrying direction, also referred to as a sheet width direction) is performed by the jogger fences 53. At breaks of jobs, that is, between the alignment of the final paper of the sheet bundle and the alignment of the first paper of the next sheet bundle, the edge surface stitching stapler S1 is driven according to the staple signal from the controller (see FIG. 15) to perform binding. The sheet bundle made by the binding is immediately sent to the shift paper discharging rollers 6 by the release belt 52 from which the release claw 52*a* projects and discharged to the shift tray 202 positioned at the receiving position.

3.2. Sheet Releasing Mechanism

A home position of the release claw 52*a* is detected by a release belt home-position sensor 311 as illustrated in FIG. 7. The release belt home-position sensor 311 is turned on and off by the release claw 52*a* provided on the release belt 52. Two release claws 52*a* and 52*a*' are provided on the periphery of the release belt 52 and arranged at opposite sides of the release belt 52 and alternately carry the sheet bundle stored in the edge surface stitching tray F. When necessary, the front end of the carrying direction of the sheet bundle stored in the edge surface stitching tray F may be aligned using the release claw 52*a* standing by for moving the sheet bundle and the release claw 52*a*' at the opposite side by reversing the release belt 52. Accordingly, the release claws 52*a* and 52*a*' also function as an aligning unit of the sheet bundle in the sheet carrying direction.

As illustrated in FIG. 5, the release belt 52 and a drive pulley 62 thereof are arranged at the alignment center in the sheet width direction on the drive shaft of the release belt 52 that is driven by a release motor 157. Release rollers 56 are arranged symmetrically with respect to the drive pulley 62. In addition, the peripheral velocity of the release rollers 56 are set to be faster than the peripheral velocity of the release belt 52. The reference numerals 64*a* and 64*b* indicate a front-side plate and a rear-side plate, the reference numerals 51*a* and 51*b* indicate a rear end fence (indicated by the reference numeral 51 in FIG. 1) on the front side and the rear side, and the reference numerals 53*a* and 53*b* indicate jogger fences on the front side and the rear side, respectively.

3.3. Processing Mechanism

Referring to FIG. 6A, the tapping roller 12 receives pendulum motion from a tapping SOL (solenoid) 170 so as to swing about a fulcrum 12*a* and intermittently abuts a sheet carried into the edge surface stitching tray F against the rear end fence 51. Note that the tapping roller 12 rotates counterclockwise. The jogger fences 53 are provided as a pair of front and rear jogger fences (53*a* and 53*b*) as shown in FIG. 5, and are driven by a reversible jogger motor 158 through the timing belt to reciprocate in the sheet width direction. The pressing Mylers 53*c* and 53*d* that press both ends of the sheet bundle in the thickness direction to suppress the curl are provided on inner sides of the jogger fences 53*a* and 53*b*. The pressing force of the pressing Mylers 53*c* and 53*d* is small or large enough to suppress the curl but not as much as to affect the movement in the carrying direction of the sheet or the sheet bundle. The pressing force is decided and set after performing experimentation.

Figure 8:
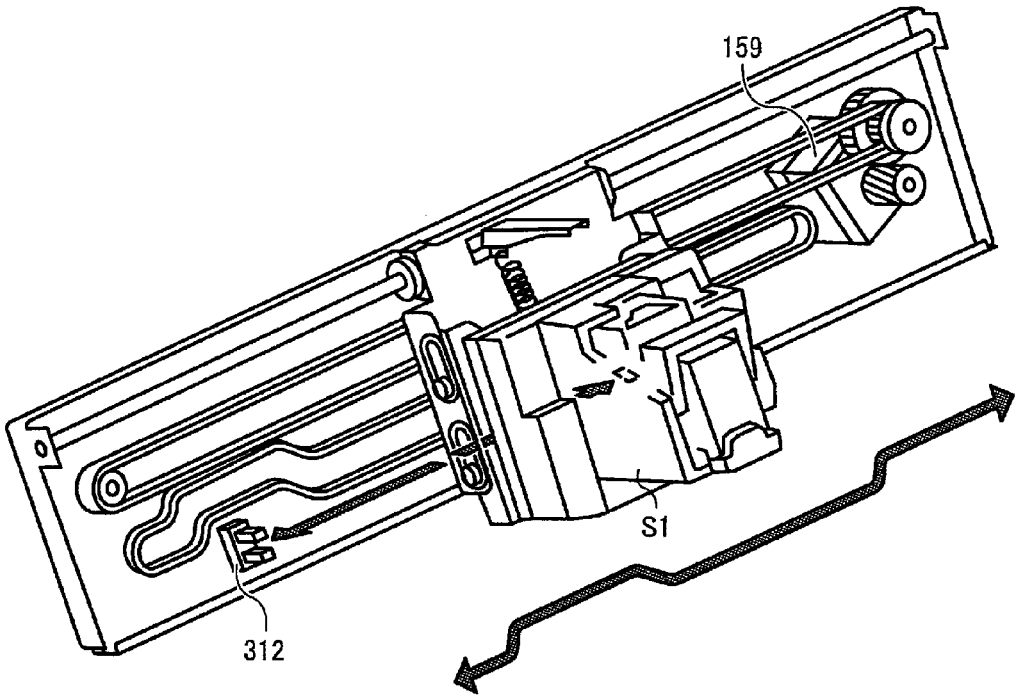
FIG. 8 is a perspective view of an edge surface stitching stapler of the sheet post-processing apparatus and a moving mechanism thereof.
Figure 9:
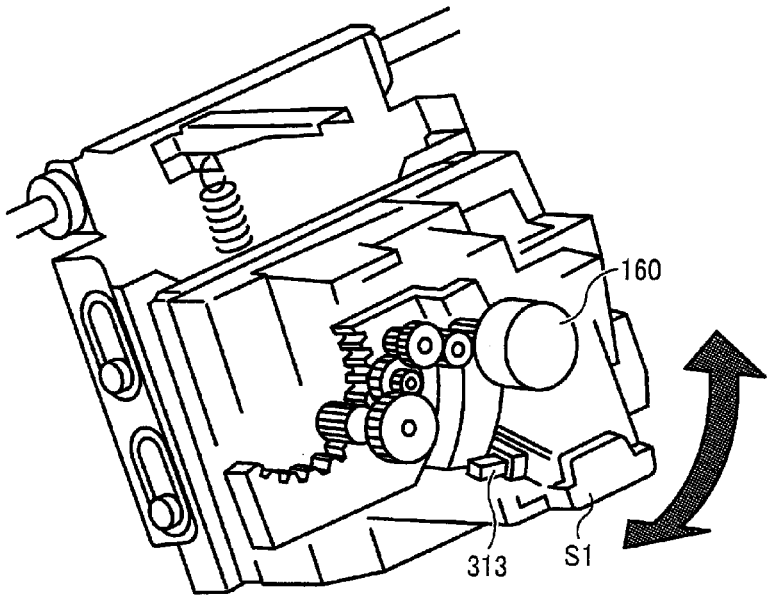
FIG. 9 is a perspective view of an obliquely rotating mechanism of the edge surface stitching stapler illustrated in FIG. 8.

Referring to FIG. 8, which is a perspective view of the stapler S1 and a moving mechanism, the edge surface stitching stapler S1 is driven by a reversible stapler moving motor 159 through the timing belt and moves in the sheet width direction for binding a predetermined position of the sheet end. At an end of the moving range, a stapler moving home-position sensor 312 is provided that detects the home position of the edge surface stitching stapler S1, and the binding position in the sheet width direction is controlled according to the moving amount of the edge surface stitching stapler S1 from the home position. The end binding stapler S1 configured such that an insertion angle of a needle can be changed so as to be parallel or oblique with respect to the sheet end as illustrated in the perspective view of FIG. 9. Moreover, a staple needle can easily be changed by obliquely rotating the binding mechanism of the stapler S1 by a predetermined angle when the stapler S1 is at the home position. The stapler S1 obliquely rotates by an obliquely drive motor 160. If a stapler diagonal home-position sensor 313 detects that the stapler S1 have reached a predetermined oblique angle or the needle change position, the obliquely drive motor 160 stops. When the oblique stapling or needle change is completed, the binding mechanism rotates back to the original position to prepare for the next stapling.

Components of the edge surface stitching tray F are provided between the side plates 64*a* and 64*b* in FIG. 5. A slide shaft 66 is one of the components, and a pair of the rear end fences 51 slides along the slide shaft 66. Referring to FIG. 5, the reference numeral 51*a* indicates the rear end fence on the front side the reference numeral 51*b* indicates the rear end fence on the rear side because the rear end fences are separately provided on both sides. A pulling spring 67 is provided between the rear end fences 51*a* and 51*b*. The pulling spring 67 constantly urges the rear end fences 51*a* and 51*b* to be closer to each other to make the fences return to their home positions. The reference numeral 310 indicates a paper presence/absence sensor that detects the presence or the absence of a sheet on the edge surface stitching tray F, the reference numeral 161 indicates a bundle branching drive motor described later, the reference numeral 61 indicates a cam, and the reference numeral 55 indicates a movable guide.

3.4. Sheet Bundle Rear End Pressing Mechanism

FIG. 6B is a diagram of a mechanism for pressing the rear-end bulk of the sheet bundle stacked on the edge surface stitching tray F. Although the sheets discharged on the edge surface stitching tray F are aligned for every sheet in the longitudinal direction (the sheet carrying direction) by the tapping roller 12 as described above, if the rear end of the sheet stacked on the edge surface stitching tray F is curled or soft, the rear end tends to buckle and become bulky by the own weight. Moreover, when the number of the stacked sheets is increased, the spaces in the rear end fences 51 into which the next sheet enters becomes small and the alignment accuracy in the longitudinal direction tends to be reduced. Accordingly, this end pressing mechanism reduces the rear-end bulk of the sheet so that the sheet is easily inserted into the rear end fences 51 and presses the curled portion of the rear end so that the alignment in the longitudinal direction (sheet carrying direction) can be performed with high accuracy.

Referring to FIG. 6B, the rear end pressing mechanism presses the rear end of the sheet stored in the rear end fences 51 by rear end pressing levers 110. The rear end pressing levers 110 are positioned at the lower end of the rear end fences 51 and reciprocate in the direction approximately orthogonal to the edge surface stitching tray F. These rear end pressing levers 110*a*, 400, and 110*c* are arranged at the front, at the center, and at the back, respectively, of the machine as illustrated in FIG. 6C.

In this embodiment, the rear end pressing lever 400 at the center has a double structure, and a pressing surface of the rear end pressing lever is biforked. In other words, the rear end pressing lever at the center includes the rear end pressing lever 400 and an auxiliary rear end pressing lever 401. Biforked pressing surfaces 400*a*, 400*b*, of the rear end pressing lever 400, and biforked pressing surfaces 401*a*, and 401*b* of the rear end pressing lever 401 can press wide range of area around the center of the sheet. In addition, the rear end pressing lever 400 and the auxiliary rear end pressing lever 401 are arranged so that both levers can press the sheet surface at positions symmetrical to the sheet center. Accordingly, the levers can press the rear-end bulk of the sheet in a balanced manner.

As described above, the release claw 52*a* discharges a sheet bundle in the releasing direction by lifting the center of the sheet bundle. Upon lifting, the release claw 52*a* passes between the biforked pressing surfaces 400*a*, 400*b*, of the rear end pressing lever 400, and the biforked pressing surfaces 401*a*, and 401*b* of the auxiliary rear end pressing lever 401. Therefore, a size a between the biforked pressing surfaces 400*a* and 400*b*, a size b between the biforked pressing surfaces 401*a* and 401*b*, and a depth of the biforked pressing surfaces are so determined that the release claw 52*a* can pass therebetween without contacting the surfaces. As a result, even when the release claw 52*a* becomes out of control and moves in the releasing direction while the rear end pressing lever 400 and the auxiliary rear end pressing lever 401 are pressing the rear end of the sheet bundle, the rear end pressing lever 400 and the auxiliary rear end pressing lever 401 do not interfere with the release claw 52*a*.

Referring to FIG. 6C, a slider 406 operates in the rear end pressing direction along with a movement of a timing belt 407 that operates together with a motor not shown. At this time, the rear end pressing lever 400 slides along first slide shafts 402 and 403, and the auxiliary rear end pressing lever 401 slides along second slide shafts 404 and 405. In addition, the auxiliary rear end pressing lever 401 is freely fit in the slider 406. Therefore, the auxiliary rear end pressing lever 401 cannot move in the vertical direction but can slide in the rear end pressing direction and is pressurized by a compression spring 410. The compression spring 410 is for coping with the sheet thickness. The compression spring 410 is compressed with an increased sheet thickness, thereby compressing the sheet bundle to press the bulk.

When operating in the rear end pressing direction, the auxiliary rear end pressing lever 401 contacts and pushes the rear end pressing lever 400. Therefore, the sheet rear end pressing lever 400 is also operated by the auxiliary rear end pressing lever 401 so that the rear end of the sheet is pressed by the two pressing levers 400 and 401. The rear end pressing lever 400 is coupled to the auxiliary rear end pressing lever 401 by a pulling spring 408. If the auxiliary rear end pressing lever 401 returns to the home position (moves in the direction opposite to the rear end pressing direction), the rear end pressing lever 400 is pulled by the pulling spring 408, and therefore, both levers return to a standby position.

The biforked pressing surfaces 400*a* and 400*b* of the rear end pressing lever 400 and the biforked pressing surfaces 401*a* and 401*b* of the auxiliary rear end pressing lever 401 are approximately parallel to the stacked sheet surface, i.e., parallel to the sheet stacked surface of the edge surface stitching tray F, thereby preventing force in a direction of pushing up the sheet to be applied upon pressing.

3.5. Sheet Bundle Deviation Mechanism

The sheet bundle saddle stitched in the edge surface stitching tray F is saddle folded. The saddle folding is performed in a saddle stitching and saddle folding tray G. To this end, the aligned sheet bundle needs to be carried to the saddle stitching and saddle folding tray G. In this embodiment, a sheet bundle deviating unit that carries the sheet bundle to the saddle stitching and saddle folding tray G side is provided on the most downstream side in the carrying direction of the edge surface stitching tray F.

Figure 16:
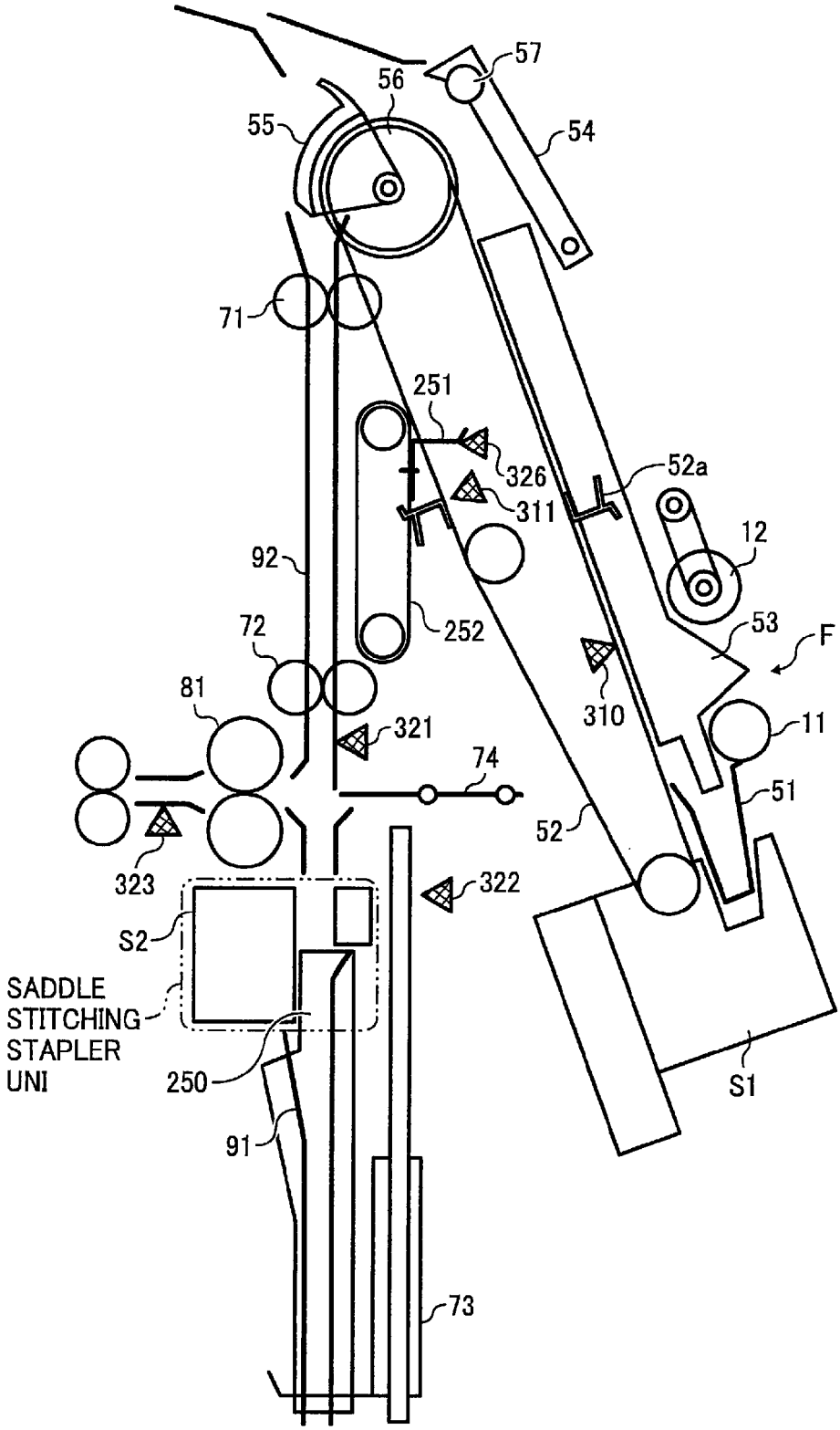
FIG. 16 is a diagram of the detail of the edge surface stitching tray and a saddle stitching and saddle folding tray of the sheet post-processing apparatus.
Figure 17:
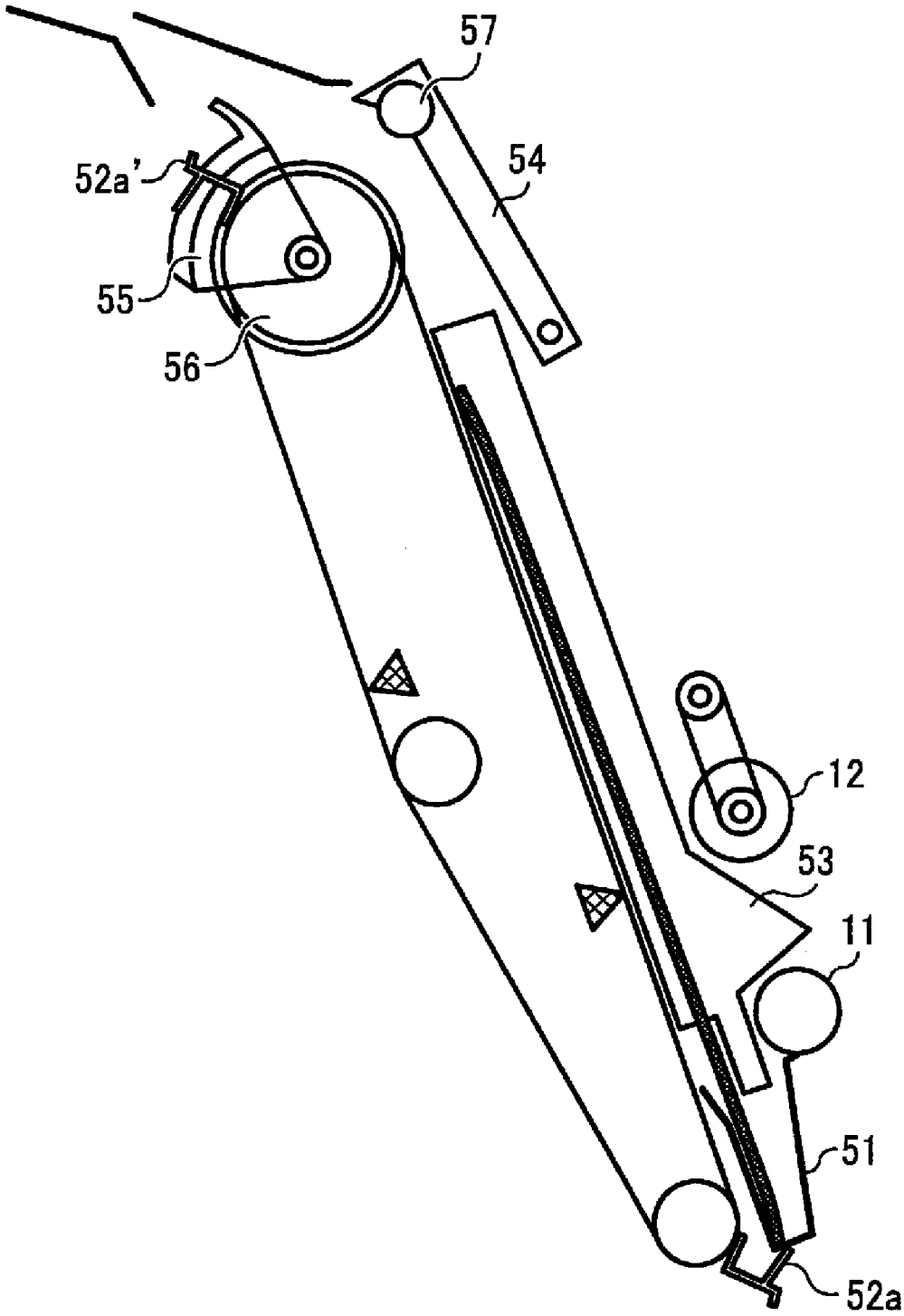
FIG. 17 is a diagram of an operation performed by a sheet bundle in the edge surface stitching tray.

The sheet bundle deviation mechanism includes the branching guide plate 54 and the movable guide 55 as illustrated in FIG. 1 and the enlarged view of the edge surface stitching tray F and the saddle stitching and saddle folding tray G of FIG. 16. Referring to diagrams of the operations in FIGS. 10 to 12, the branching guide plate 54 is provided so as to be vertically swingable about a fulcrum 54*a*. A pressurizing roller 57 pressurized by a spring 58 to the release roller 56 side is rotatably provided on the downstream side of the branching guide plate 54. The position of the branching guide plate 54 is regulated by the contact position with a cam surface 61*a* of the cam 61 rotated by the bundle branching drive motor 161.

Figure 10:
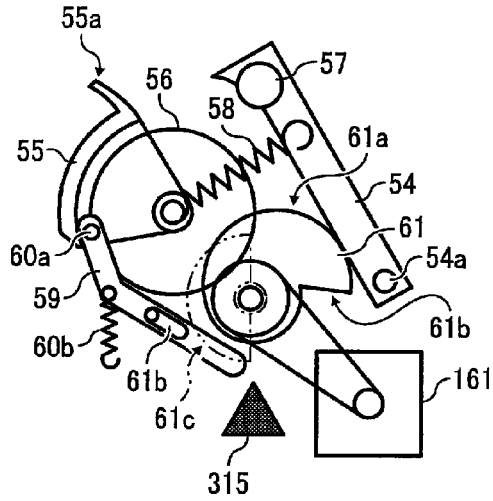
FIG. 10 is a diagram of an operation performed by a sheet bundle deviation mechanism of the sheet post-processing apparatus when a sheet or a sheet bundle is discharged to a shift tray.

The movable guide 55 is swingably supported with a rotation shaft of the release roller 56. A link arm 60 is rotatably coupled to one end (the end opposite to the branching guide plate 54) of the movable guide 55 via a coupling unit 60*a*. A shaft of the link arm 60 fixed to the front-side plate 64*a* illustrated in FIG. 5 is freely fit in a slot 60*b*, thereby regulating the swinging range of the movable guide 55. In addition, the link arm 60 is held at the position as illustrated in FIG. 10 by being urged downward by a spring 59. When the link arm 60 is pushed by a cam surface 61*b* of the cam 61 rotated by the bundle branching drive motor 161, the coupled movable guide 55 rotates upward.

A bundle branching guide home-position sensor 315 detects a shield 61*c* of the cam 61 to detect the home position of the cam 61. Accordingly, the cam 61 counts a drive pulse of the bundle branching drive motor 161 based on the home position to control the stop position.

FIG. 10 is a diagram of the positional relationship between the branching guide plate 54 and the movable guide 55 when the cam 61 is at the home position. A guide surface 55*a* of the movable guide 55 guides a sheet at the passage to the shift paper discharging roller 6.

Figure 11:
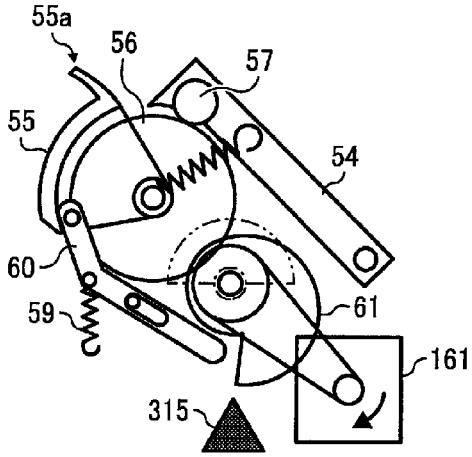
FIG. 11 is a diagram of an operation performed by the sheet bundle deviation mechanism when a branching guide plate rotates to a releasing roller side from the state of FIG. 10.

FIG. 11 is a diagram of an operation in a state where the branching guide plate 54 is rotated about the fulcrum 54*a* in a counterclockwise direction (downward) as viewed in FIG. 11 by rotating the cam 61. Thus, the pressurizing roller 57 contacts and pressurizes the release roller 56.

Figure 12:
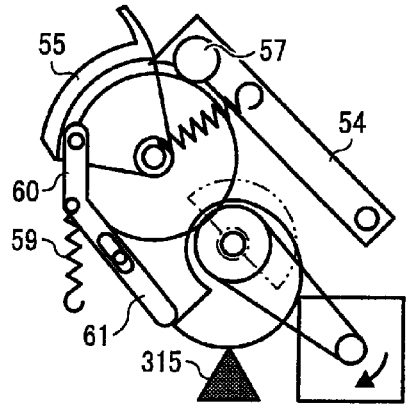
FIG. 12 is a diagram of an operation performed by the sheet bundle deviation mechanism when a movable guide rotates to the side of the branching guide plate from the state of FIG. 11 to form a passage to deviate a sheet bundle to a saddle stitching and saddle folding tray side.

FIG. 12 is a diagram of an operation in a state where the branching guide plate 54 is rotated in the clockwise direction (upward) as viewed in FIG. 12 by further rotating the cam 61. Referring to FIG. 12, the branching guide plate 54 and the movable guide 55 form a passage guiding a sheet bundle from the edge surface stitching tray F to the saddle stitching and saddle folding tray G. The positional relationship in the depth direction is illustrated in FIG. 5.

In this embodiment, the branching guide plate 54 and the movable guide 55 are operated by a single drive motor. Instead, the branching guide plate 54 and the movable guide 55 may be operated by different drive motors, and therefore, the moving timing and the stop position may be controlled according to the sheet size and the number of binding sheet.

4. Saddle Stitching and Saddle Folding Tray

Figure 25:
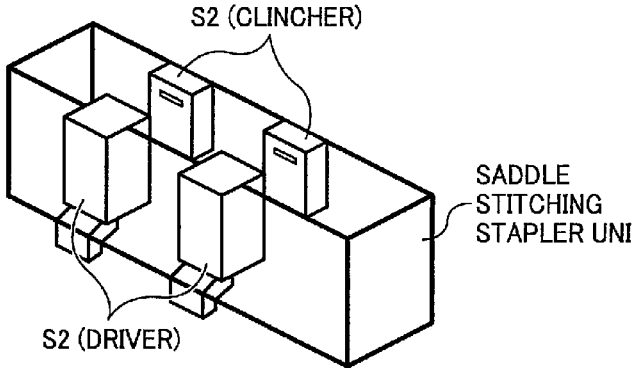
FIG. 25 is a schematic perspective view of a saddle stitching stapler unit.

The saddle stitching and saddle folding tray G is provided on the downstream side of the sheet bundle deviation mechanism including the movable guide 55 and the release roller 56 as illustrated in FIG. 1. The saddle stitching and saddle folding tray G is provided approximately vertically on the downstream side of the sheet bundle deviation mechanism. In the saddle stitching and saddle folding tray G, a saddle folding mechanism is arranged at the center part, a bundle carrying guide upper plate 92 is arranged at the upper part, and a bundle carrying guide lower plate 91 is arranged at the lower part. In addition, in the bundle carrying guide upper plate 92, a bundle carrying upper roller 71 is provided at the upper part and a bundle carrying lower roller 72 is provided at the lower part. A saddle stitching jogger fences 250 are provided along both sides of the bundle carrying guide lower plate 91, and a saddle stitching stapler unit (saddle stitching stapler UNI) is arranged at the position where the saddle stitching jogger fences 250 are provided. The saddle stitching jogger fences 250 are driven by a drive mechanism not shown to perform alignment operation in the direction orthogonal to the paper carrying direction (sheet width direction). The saddle stitching stapler UNI includes pairs of a clincher and a driver as illustrated in FIG. 25. Referring to FIG. 25, two pairs of saddle stitching staplers S2 are arranged at a predetermined interval in the sheet width direction. Here the two pairs are fixed. Instead, a pair of a clincher and a driver can be moved in the sheet width direction so that binding can be performed at two positions.

Each of the bundle carrying upper roller 71 and the bundle carrying lower roller 72 is formed of a pair of a drive roller and a driven roller, and a measuring sensor for measuring the distance between the nips of the roller pair is provided on the bundle carrying upper roller 71. The measuring sensor detects the distance between the nips when the rollers pinch the sheet bundle and sends the distance to a CPU 360 described later. Thus, a controller 350 can obtain the thickness information of the sheet bundle. The CPU 360 can perform mode setting described later based on the obtained thickness information.

The movable rear end fence 73 is provided so as to be arranged across the bundle carrying guide lower plate 91, and can be moved in the sheet carrying direction (vertical direction in FIG. 1) by a moving mechanism having a timing belt and a drive mechanism thereof. The drive mechanism not shown includes a drive pulley and a driven pulley between which the timing belt is stretched and a stepping motor that drives the drive pulley. Similarly, the rear end tapping claw 251 and a driving mechanism thereof are provided on the upper end side of the bundle carrying guide upper plate 92. The rear end tapping claw 251 can be reciprocated in the direction departing from the sheet bundle deviation mechanism and in the direction pressing the rear end of the sheet bundle (the rear end of the introduced sheet bundle) by a timing belt 252 and the driving mechanism not shown. A rear end tapping claw home-position sensor 326 in FIG. 1 detects the home position of the rear end tapping claw 251.

The saddle folding mechanism is provided approximately at the center of the saddle stitching and saddle folding tray G and includes the folding plate 74, the folding roller 81, and a carrying passage H for carrying the folded sheet bundle.

4.1. Folding Plate and Operating Mechanism Thereof

Figure 13:
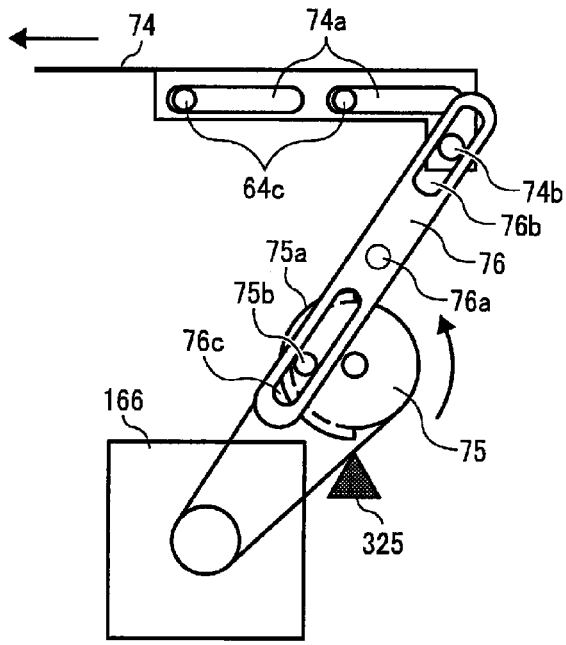
FIG. 13 is a diagram of an operation performed by a moving mechanism of a folding plate of the sheet post-processing apparatus before a saddle folding operation.
Figure 14:
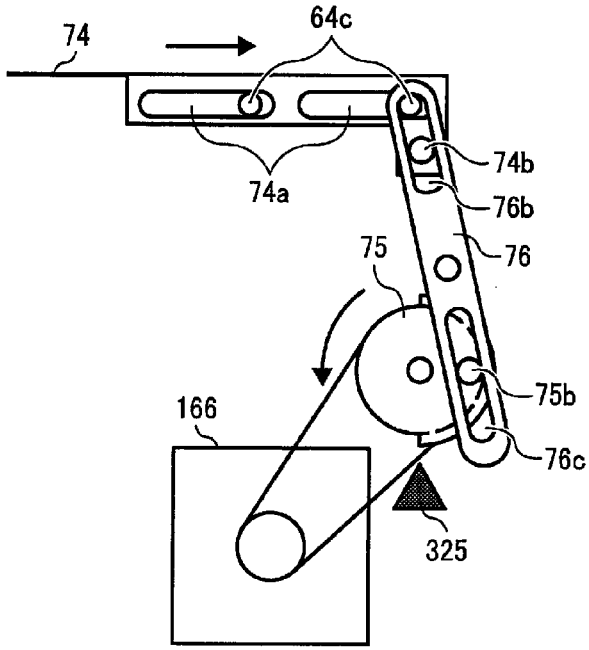
FIG. 14 is a diagram of an operation performed by the moving mechanism of the folding plate of the sheet post-processing apparatus when the folding plate returns to the home position after the saddle folding.

FIGS. 13 and 14 are diagrams of the operation performed by a moving mechanism of the folding plate 74 for saddle folding.

The folding plate 74 is supported by freely fitting two shafts 64*c* provided to stand from the front-side plate 64*a* and the rear-side plate 64*b*, respectively, into slots 74*a*. In addition, a shaft 74*b* provided to stand from the folding plate 74 is freely fit in a slot 76*b* of a link arm 76, and the folding plate 74 reciprocates in the horizontal direction in FIGS. 13 and 14 by swinging the link arm 76 about a fulcrum 76*a*.

In other words, a shaft 75*b* of a folding plate drive cam 75 is freely fit in a slot 76*c* of the link arm 76, and the link arm 76 is swung by the rotation of the folding plate drive cam 75. Accordingly, in FIG. 16, the folding plate 74 reciprocates in the direction orthogonal to the bundle carrying guide lower plate 91 and the bundle carrying guide upper plate 92.

The folding plate drive cam 75 rotates in the direction of an arrow in FIG. 13 by a folding plate drive motor 166. A folding plate home-position sensor 325 detects both ends of a semicircular shield 75*a* to determine the stop position of the folding plate drive cam 75.

FIG. 13 is a diagram of positioning in which the folding plate 74 is at the home position where the folding plate 74 has completely retreated from the sheet bundle store region of the saddle stitching and saddle folding tray G. The folding plate drive cam 75 rotates in the arrow direction to move the folding plate 74 in the arrow direction to project to the sheet bundle store region of the saddle stitching and saddle folding tray G. FIG. 14 is a diagram of the positioning in which the center of the sheet bundle in the saddle stitching and saddle folding tray G is pressed to the nip of the folding roller 81. The folding plate drive cam 75 rotates in the arrow direction to move the folding plate 74 in the arrow direction to retreat from the sheet bundle store region of the saddle stitching and saddle folding tray G.

In this embodiment, the saddle folding is performed on the sheet bundle. Instead, the saddle folding may be performed on a single sheet. In this case, the saddle stitching is not required because the sheet is only one. A single discharged sheet is carried to the saddle stitching and saddle folding tray G side to be folded by the folding plate 74 and the folding roller and then discharged to the lower tray 203. The reference numeral 323 indicates a folding unit passing sensor that detects a folded sheet, the reference numeral 321 indicates a bundle detection sensor that detects that the sheet bundle have reached the saddle folding position, and the reference numeral 322 indicates a movable rear end fence home-position sensor that detects the home position of the movable rear end fence 73. Moreover, in this embodiment, a detection lever 501 that detects a stacking height of the saddle folded sheet bundle on the lower tray 203 is swingably provided by a fulcrum 501*a*. A paper surface sensor 505 detects the angle of the detection lever 501 to elevate the lower tray 203 and to detect an overflow of the lower tray 203.

5. Controller

Figure 15:
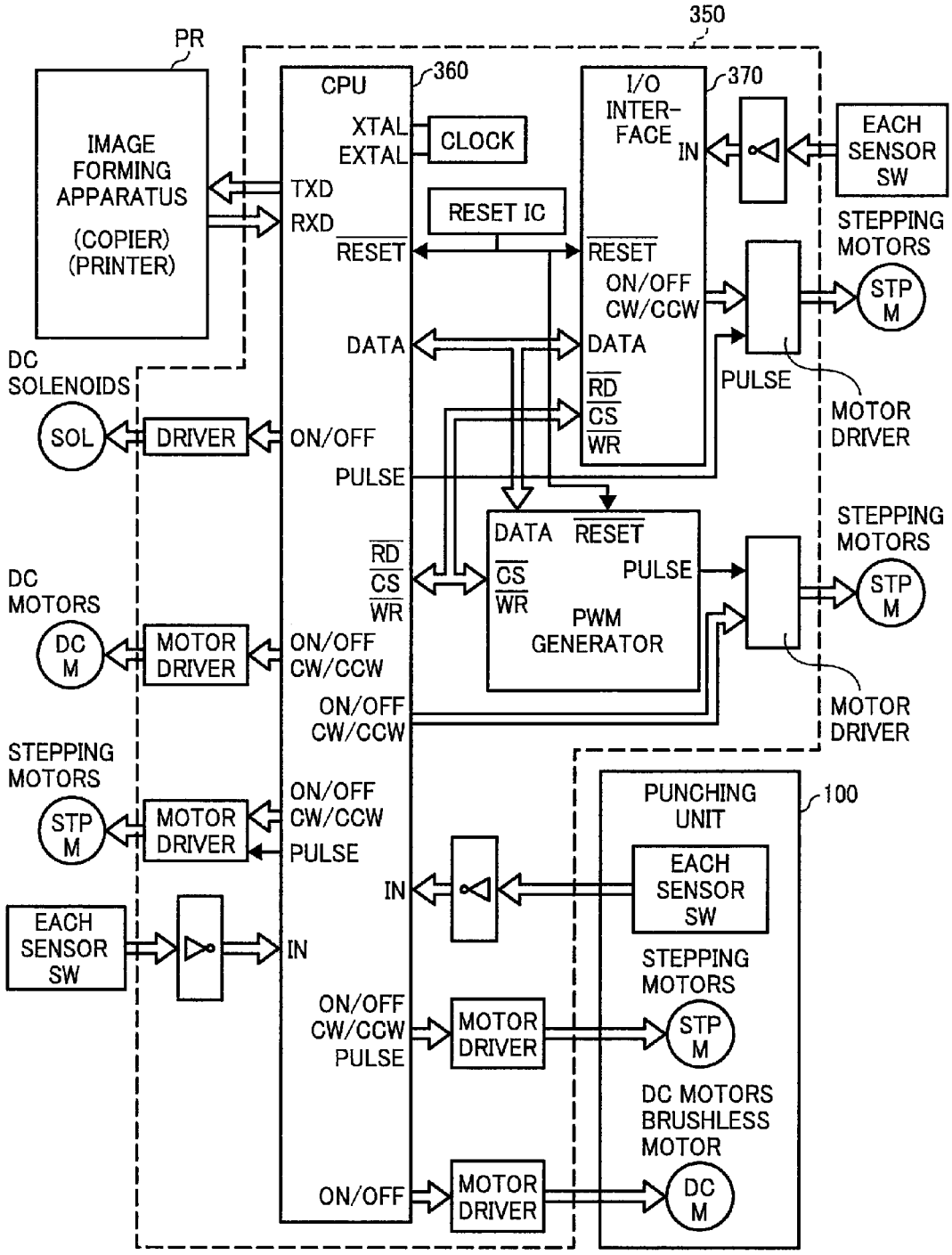
FIG. 15 is a block diagram of a control circuit of the sheet post-processing apparatus and an image forming apparatus.

The controller 350 includes a microcomputer having the CPU 360, an input/output (I/O) interface 370, and the like as illustrated in FIG. 15. In the controller 350, the CPU 360 receives, via the I/O interface 370, signals from: the switches of the control panel of the main unit of the image forming apparatus PR; and the sensors such as the entrance sensor 301, an upper paper discharging sensor 302, the shift paper discharging sensor 303, the pre-stack sensor 304, a staple paper discharging sensor 305, the paper presence/absence sensor 310, the release belt home-position sensor 311, the stapler moving home-position sensor 312, the stapler diagonal home-position sensor 313, a jogger fence home-position sensor, the bundle branching guide home-position sensor 315, the bundle reach sensor 321, the movable rear end fence home-position sensor 322, the folding unit passing sensor 323, the folding plate home-position sensor 325, the paper surface detecting sensors 330, 330*a*, and 330*b*, and the paper discharging guide plate open/close sensor 331.

Based on the input signal, the CPU 360 controls the drive of: the tray elevating motor 168 for the shift tray 202; the paper discharging guide plate open/close motor 167 that opens or closes the open/close guide plate; the shift motor 169 that moves the shift tray 202; a tapping roller motor (not shown) that drives the tapping roller 12; the solenoids of the tapping SOL 170 and the like; the carrying motor that drives the carrying rollers; the paper discharging motor that drives the paper discharging rollers; the release motor 157 that drives the release belt 52; the stapler moving motor 159 that moves the edge surface stitching stapler S1; the obliquely drive motor 160 that obliquely rotates the edge surface stitching stapler S1; the jogger motor 158 that moves the jogger fences 53; the bundle branching drive motor 161 that rotates the branching guide plate 54 and the movable guide 55; the bundle carrying motor (not shown) that drives the carrying roller carrying the bundle; the rear end fence moving motor (not shown) that moves the movable rear end fence 73; the folding plate drive motor 166 that moves the folding plate 74; and the folding roller drive motor that drives the folding roller 81. The pulse signal of a staple carrying motor, not shown, that drives the staple paper discharging roller is input to the CPU 360 to be counted, and the tapping SOL 170 and the jogger motor 158 is controlled based on the counting.

The folding roller drive motor is a stepping motor directly controlled by the CPU 360 through a motor driver or indirectly controlled via the I/O interface 370 and the motor driver. The punching unit performs punching based on the instruction from the CPU 360 by controlling a clutch or a motor.

The CPU 360 executes the computer program written into a ROM not shown using a RAM not shown as a work area to control the sheet post-processing apparatus PD.

6. Operation

An operation performed by the sheet post-processing apparatus according to the embodiment through the CPU 360 will now be described.

6.1. Modes and Discharging Formation

In this embodiment, the sheets are discharged according to the following five post-processing modes:

- Non-staple mode a: a mode in which a sheet is discharged to the upper tray 201 through the carrying passages A and B;
- Non-staple mode b: a mode in which a sheet is discharged to the shift tray 202 through the carrying passages A and C;
- Sort and stack mode: a mode in which a sheet is discharged to the shift tray 202 through the carrying passages A and C and the shift tray 202 swings in a direction orthogonal to the paper discharging direction every time a set of sheets is discharged to sort the discharged sheets;
- Staple mode: a mode in which the sheet bundle that have passed through the carrying passages A and D is aligned and bound at the edge surface stitching tray F, and then discharged to the shift tray 202 through the carrying passage C; and
- Saddle stitch binding mode: a mode in which the sheet bundle that have passed through the carrying passages A and D is aligned and saddle stitched at the edge surface stitching tray F, folded at the saddle stitching and saddle folding tray G, and discharged to the lower tray 203 through the carrying passage H.

The operations of the modes are described below.

(1) Operation of the Non-Staple Mode a

The sheet from the carrying passage A is distributed to the carrying passage B by the branching claw 15 to be discharged to the upper tray 201 by the carrying roller 3 and the upper paper discharging roller 4. A paper discharging condition is monitored by the upper paper discharging sensor 302, which detects the sheet discharging, arranged close to the upper paper discharging roller 4.

(2) Operation of the Non-Staple Mode b

The sheet from the carrying passage A is distributed to the carrying passage C by the branching claws 15 and 16 to be discharged to the shift tray 202 by the carrying roller 5 and the shift paper discharging roller 6. The paper discharging condition is monitored by the shift paper discharging sensor 303, which detects the sheet discharging, arranged close to the shift paper discharging roller 6.

(3) Operation of the Sort and Stack Mode

The sheet is carried and discharged in the same manner as that of the non-staple mode b. At this time, the shift tray 202 swings in the paper discharging direction and the direction orthogonal thereto for every set of sheets to sort the discharged sheets.

(4) Operation of the Staple Mode

The sheet from the carrying passage A is distributed to the carrying passage D by the branching claws 15 and 16 and discharged to the edge surface stitching tray F by the carrying rollers 7, 9, and 10 and the staple paper discharging roller 11. The edge surface stitching tray F aligns the sheets sequentially discharged by the staple paper discharging roller 11, and performs binding by the edge surface stitching stapler S1 when the number of the discharged sheets reaches a predetermined amount. Subsequently, the bound sheet bundle is carried downward by the release claw 52*a* and discharged to the shift tray 202 by the shift paper discharging roller 6. The paper discharging state is monitored by the shift paper discharging sensor 303 that is arranged close to the shift paper discharging roller 6 and detects the sheet discharging.

When the staple mode is selected, as shown in FIGS. 6A to 6C, the jogger fences 53 move from the home position and waits at the standby positions each being apart from corresponding side in the width direction of the sheet discharged to the edge surface stitching tray F by 7 millimeters. The sheet is carried by the staple paper discharging roller 11. When the rear end of the sheet passes through the staple paper discharging sensor 305, both jogger fences 53 move inward by 5 millimeters from the standby position and stop. The staple paper discharging sensor 305 detects the passing of the rear end of the sheet, and the detected signal is input to the CPU 360 (see FIG. 15). The CPU 360 counts the number of the outgoing pulses from the staple carrying motor not shown that drives the staple paper discharging roller 11 when the CPU 360 receives the signal, and turns the tapping SOL 170 on after a predetermined amount of pulse is sent out. The tapping roller 12 swings according to on or off of the tapping SOL 170. When the tapping SOL 170 is turned on, the returning roller 12 taps the sheets to return downward and performs the paper alignment by abutting the sheets on the rear end fences 51. Every time a sheet to be stored in the edge surface stitching tray F passes through the entrance sensor 301 or the staple paper discharging sensor 305, a signal is input to the CPU 360 and the number of sheets is counted.

When a predetermined time has passed after the tapping SOL 170 is turned off, the jogger fences 53 are further moved inward by 2.6 millimeters by the jogger motor 158 and stops. The alignment in the lateral direction is thus completed. Subsequently, the jogger fences 53 move outward by 7.6 millimeters to return to the standby positions and wait for the next sheet. This operation is continued until the final sheet is aligned. Subsequently, the jogger fences 53 move inward again by 7 millimeters and stop and then holds both ends of the sheet bundle to prepare for the stapling. The edge surface stitching stapler S1 is operated by a staple motor not shown after a predetermined time and the binding is performed. At this time, if two or more positions for binding are specified, the stapler moving motor 159 is driven after the binding at the first position to move the edge surface stitching stapler S1 to the appropriate position along the sheet rear end and the binding is performed at the second position. If three or more positions are specified, this operation is repeated.

When the binding processing is completed, the release motor 157 is driven to drive the release belt 52. At this time, the paper discharging motor is also driven to rotate the shift paper discharging roller 6 to receive the sheet bundle that is lifted by the release claw 52*a*. The jogger fences 53 are controlled differently depending on the sheet size and the number of binding sheets. For example, if the number of the binding sheets is smaller than the set number or the size of the binding sheets is smaller than the set size, the release claw 52*a* hooks the rear end of the sheet bundle to carry while the jogger fences 53 hold the sheet bundle. Upon receiving a predetermined amount of pulse after the detection of the paper presence/absence sensor 310 or the release belt home-position sensor 311, the jogger fences 53 retreat by 2 millimeters to release the sheet. The predetermined amount of pulse is set to be sent during the period starting when the release claw 52*a* becomes in contact with the rear end of the sheet and until the release claw 52*a* passes through the front end of the jogger fences 53. If the number of the binding sheets is larger than the set number or the size of the binding sheets is larger than the set size, the jogger fences 53 are retreated by 2 millimeters in advance and the sheet is released. In both cases, when the sheet bundle have completely passed through the jogger fences 53, the jogger fences 53 further move outward by 5 millimeters to return to the standby position and prepare for the next sheet. Binding force may be adjusted based on the distance between the sheet and the jogger fences 53.

(5) Operation of the Saddle Stitch Binding Mode

FIG. 16 is a front view of the edge surface stitching tray F and the saddle stitching tray G. FIGS. 17 to 24 are diagrams of the operation when the saddle stitch binding mode is selected.

Referring to FIG. 1, The sheet from the carrying passage A is distributed to the carrying passage D by the branching claws 15 and 16 to be discharged to the edge surface stitching tray F illustrated in FIG. 16 by the carrying rollers 7, 9, and 10, and the staple paper discharging roller 11. In the edge surface stitching tray F, the sheets sequentially discharged by the staple paper discharging roller 11 are aligned in a manner similar to that of the staple mode described at (4). Until just before the stapling, the same operations as those of the staple mode are performed (see FIG. 17 that is a diagram of the sheet bundle aligned by the rear end fences 51).

Figure 18:
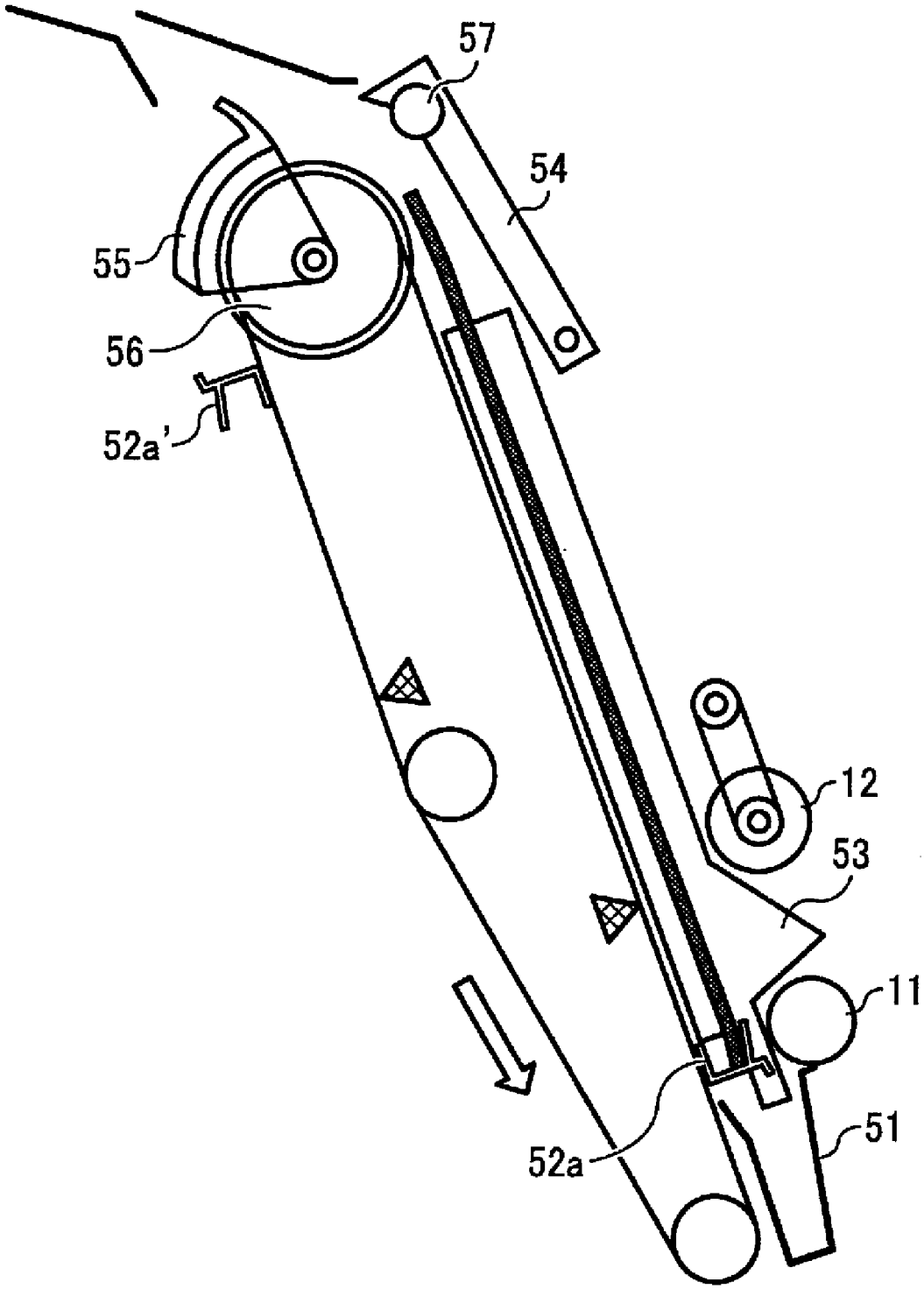
FIG. 18 is a diagram of an operation performed upon transporting a sheet bundle from the edge surface stitching tray to the saddle stitching and saddle folding tray.
Figure 19:
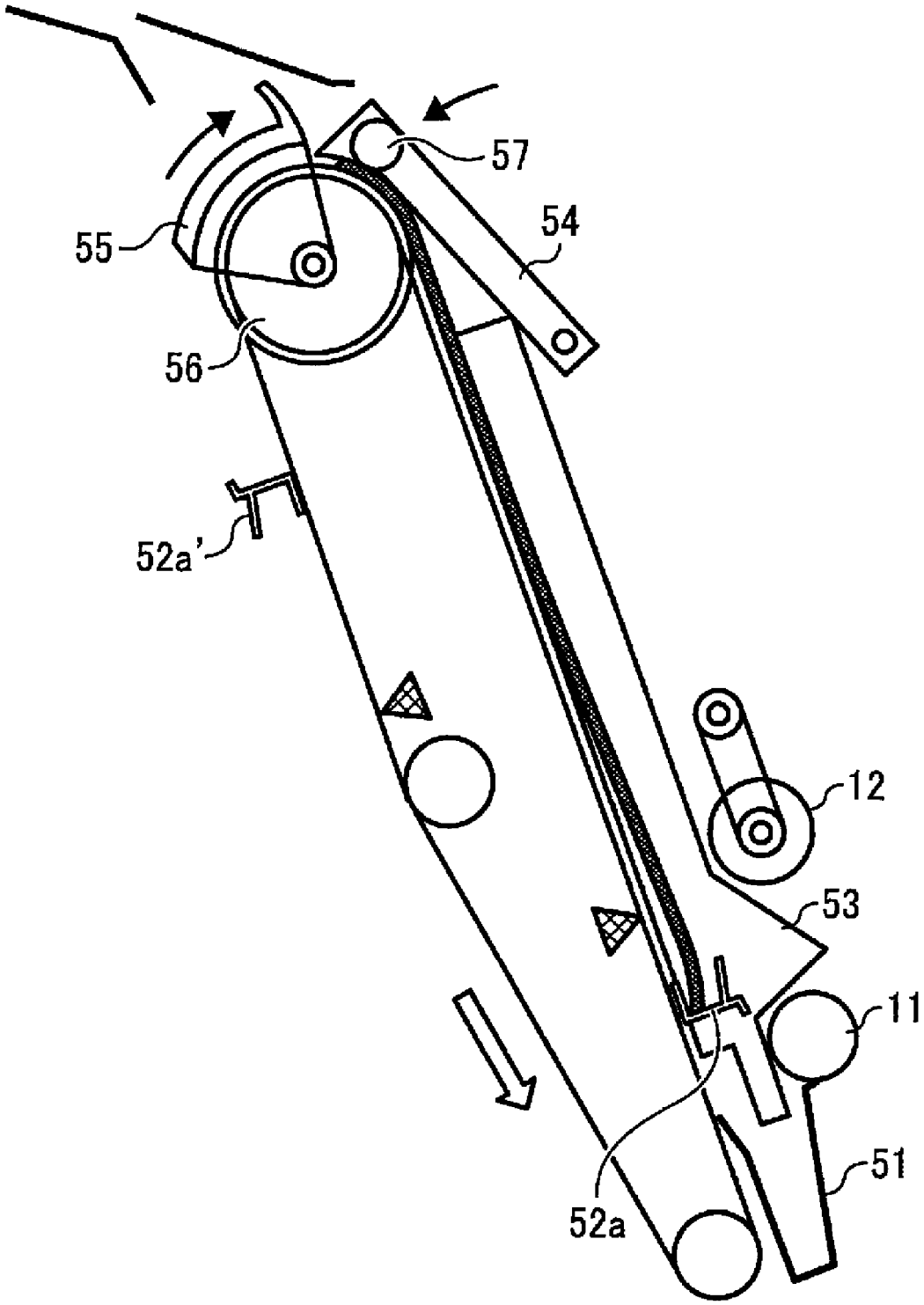
FIG. 19 is a diagram of an operation performed upon deviating and transporting the sheet bundle from the edge surface stitching tray to the saddle stitching and saddle folding tray.
Figure 20:
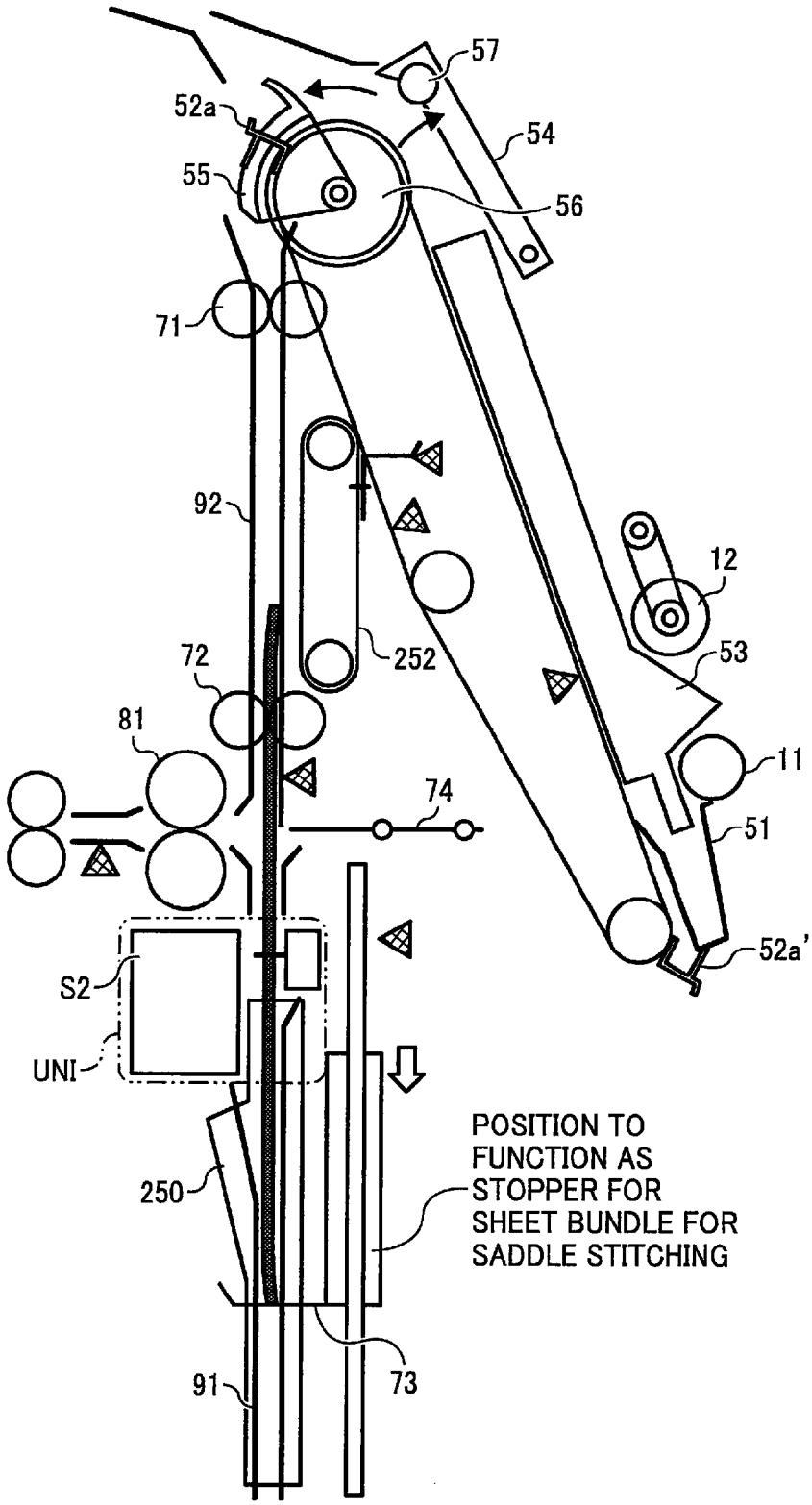
FIG. 20 is a diagram of an operation when the sheet bundle is transported from the edge surface stitching tray to the saddle stitching and saddle folding tray.

After the sheet bundle is temporarily aligned in the edge surface stitching tray F, the sheet bundle is lifted by the release claw 52*a* as illustrated in FIG. 18. The front end of the sheet bundle is pinched by the release roller 56 and the pressurizing roller 57 as illustrated in FIG. 19. Subsequently, the branching guide plate 54 and the movable guide 55 rotate so that the passage to the saddle stitching and saddle folding tray G is formed as described above. The sheet bundle receives drive force from the release claw 52*a* and the release roller 56 and is carried to the saddle stitching and saddle folding tray G side through the passage. The release roller 56 is provided on the drive shaft of the release belt 52 and driven in synchronization with the release belt 52.

Figure 21:
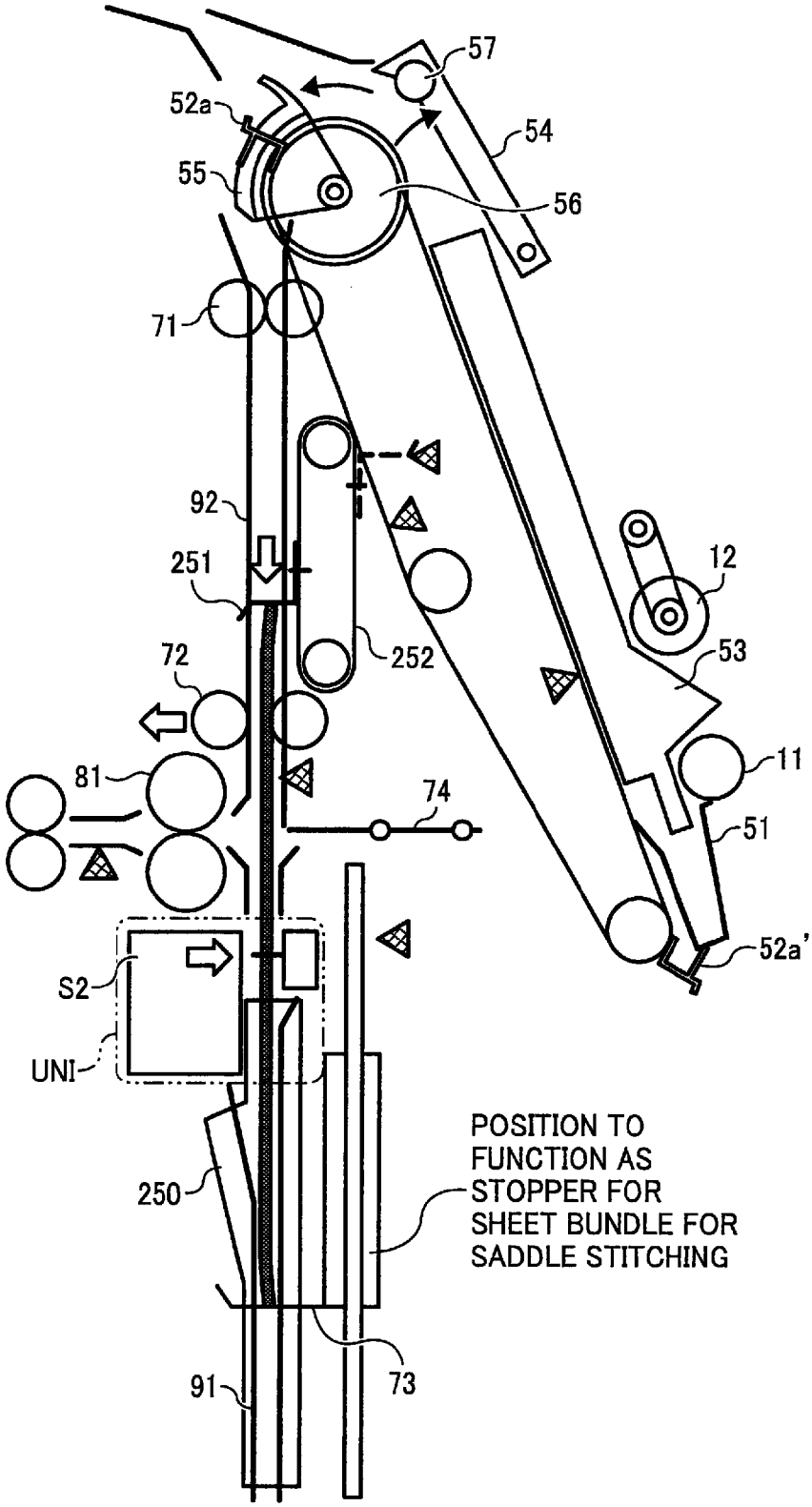
FIG. 21 is a diagram of the operation when the pressurizing force of a sheet bundle carrying roller is released in the saddle stitching and saddle folding tray, the sheet bundle is stopped at the saddle stitching position by a movable rear end fence, the alignment in the sheet carrying direction is performed by a rear end tapping claw, and the sheet bundle is saddle stitched.

After that, the sheet bundle is carried by the release claw 52*a* until the rear end of the sheet bundle passes through the release roller 56. Then, the sheet bundle is further carried to the position illustrated in FIG. 20 by the bundle carrying upper roller 71 and the bundle carrying lower roller 72. The stop position of the movable rear end fence 73 is set according to the size of each sheet bundle in the carrying direction. The movable rear end fence 73 stands by at the position corresponding to the sheet size. When the front end of the sheet bundle contacts the movable rear end fence 73 standing by and the sheet bundle is stacked, the pressure of the bundle carrying lower roller 72 is released as illustrated in FIG. 21, and the rear end tapping claw 251 taps the rear end of the sheet bundle to perform the final alignment in the carrying direction. On the other hand, the sheet bundle is aligned in the width direction by the saddle stitching jogger fences 250 provided on the positions lower than the saddle stitching stapler UNI. Accordingly, the width direction of the sheet bundle is aligned by the saddle stitching jogger fences 250 and the length direction (the carrying direction) of the sheet bundle is aligned by the movable rear end fence 73 and the rear end tapping claw 251, respectively.

The pressing amount of the stopper (the movable rear end fence 73) or the saddle stitching jogger fences 250 are changed to the optimal amount for aligning based on the size information, the information about the number of the sheets, and the information about the bundle thickness. If the thickness of the bundle is large, the space in the carrying passage is decreased, and therefore, the sheets are less likely to be aligned by only one alignment operation. Thus, the number of the alignment operations can be increased to achieve the alignment with high accuracy.

It is to be noted that if the number of sheets is larger, a longer time is required for sequentially overlapping the sheets on the upstream side making the interval until the next bundle can be received longer. As a result, the increase of the number of the alignment does not cause the time loss in the system, thereby achieving the alignment with high accuracy efficiently. Note that the effective processing can also be performed by controlling the number of alignment depending on the processing time at the upstream side.

The aligned sheet bundle is saddle stitched by the saddle stitching stapler S2 (FIG. 21). Accordingly, the position of the sheet bundle is positioned by the movable rear end fence 73 so that the position to be stapled by the stapler S2 matches the center position of the sheet bundle.

Figure 22:
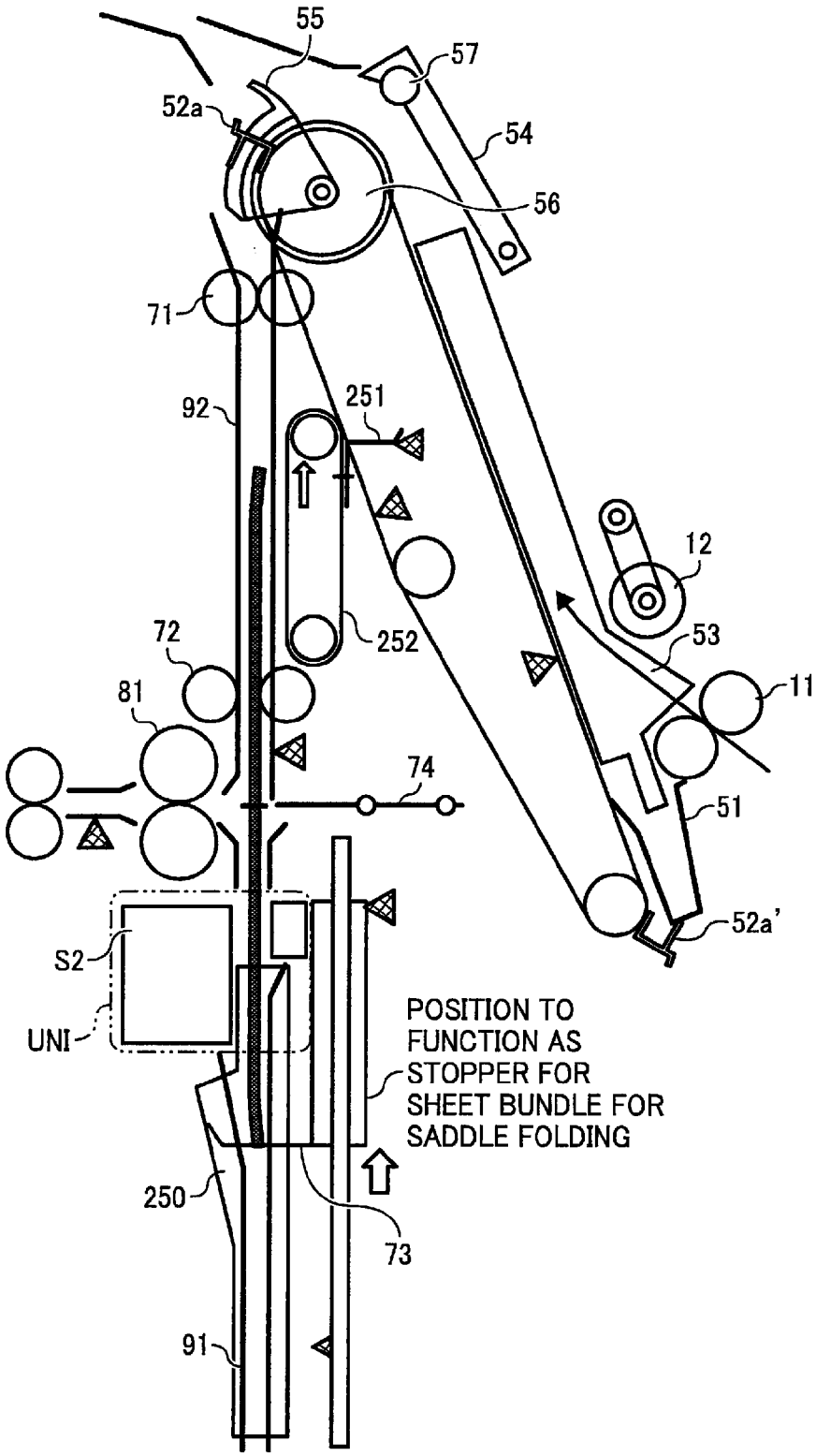
FIG. 22 is a diagram of the operation when the sheet bundle is raised from the end position for the saddle stitching to the position for the saddle folding.
Figure 23:
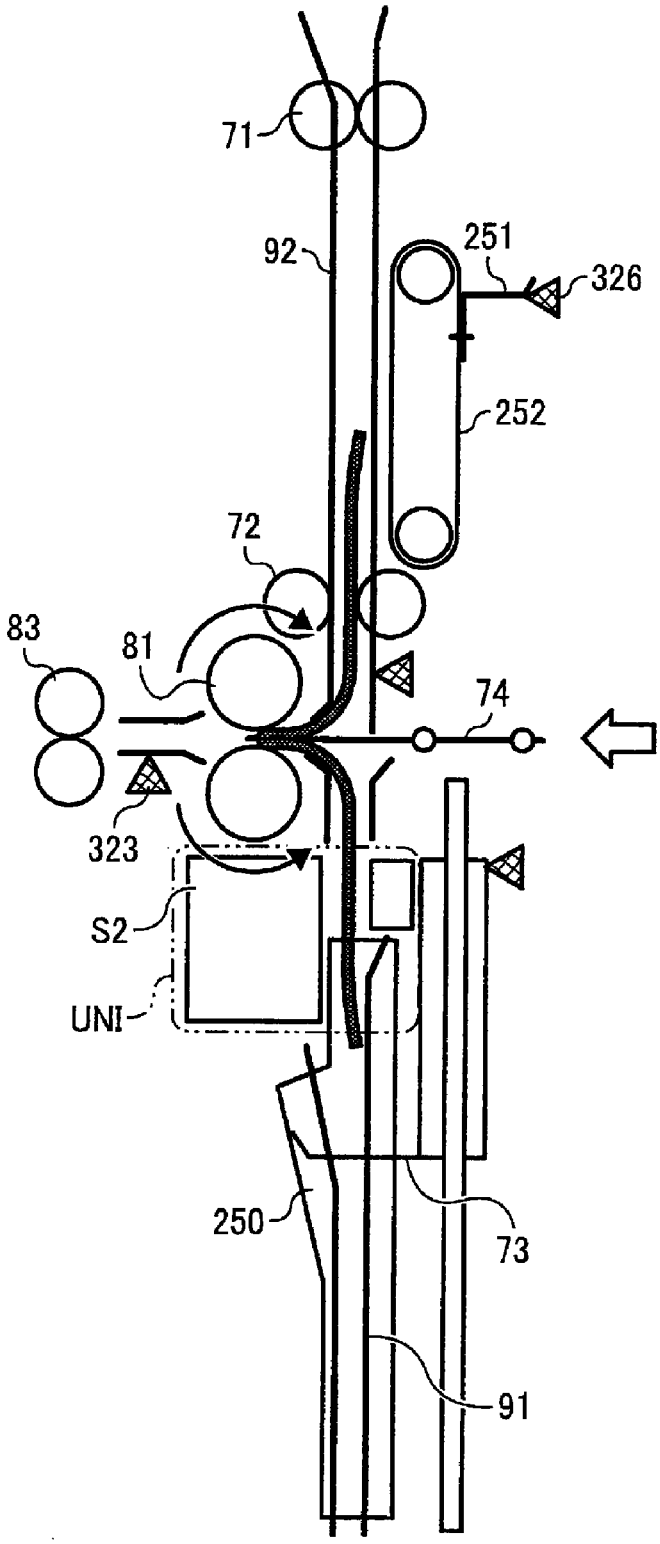
FIG. 23 is a diagram of the operation when a folding plate moves toward the sheet bundle and presses the sheet bundle into a nip of the folding roller to fold after the saddle stitching.

The movable rear end fence 73 is positioned by the pulse control from the movable rear end fence home-position sensor 322, and the rear end tapping claw 251 is positioned by the pulse control from the rear end tapping claw home-position sensor 326. As illustrated in FIG. 22, the saddle stitched sheet bundle is carried upward along with the movement of the movable rear end fence 73 while being released from the pressure from the bundle carrying lower roller 72. The sheet bundle is stopped at the position at which the folding position faces the front end of the folding plate 74. After that, as illustrated in FIG. 23, an area around the portion stitched by a needle is pushed by the folding plate 74 in the approximately orthogonal direction and the sheet bundle is guided to the nip of the folding roller 81 that faces the folding plate 74. The folding roller 81 that rotates in advance pressurizes and carries the sheet bundle to fold the center of the sheet bundle.

The sheet bundle can be surely carried by only moving the movable rear end fence 73 because the saddle stitched sheet bundle moves upward to be folded. Moving the sheet bundle downward to be folded may not be achieved only with the movement of the movable rear end fence 73 because the friction and the static electricity may hamper the sheet bundle from following the downward movement of the movable rear end fence 73, thereby providing less stable carrying. Accordingly, to move the movable rear end fence 73 downward, other units such as a carrying roller are required and the configuration becomes complicated.

Figure 24:
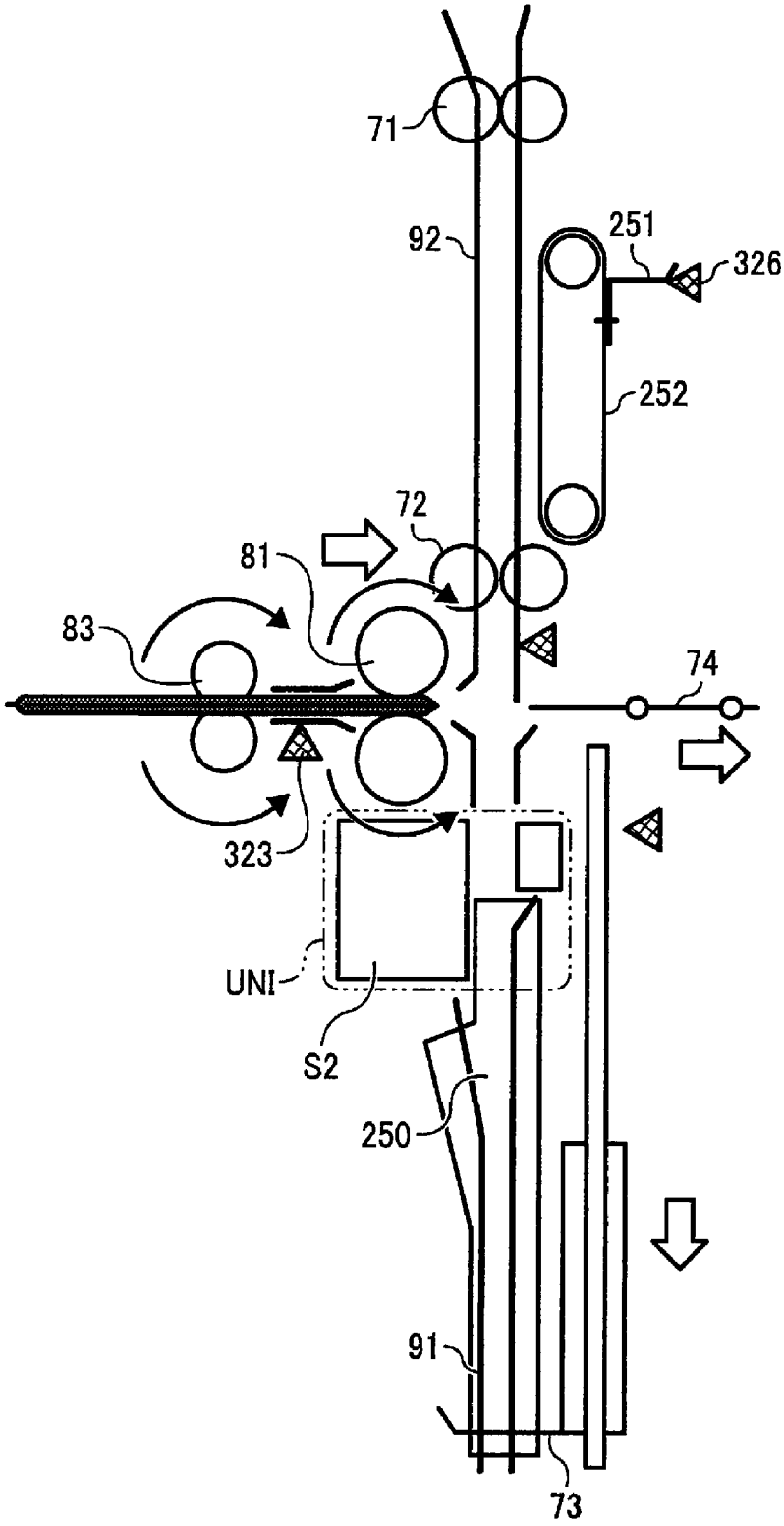
FIG. 24 is a diagram of the operation when the sheet bundle is folded by the folding roller and discharged from the paper discharging roller.

As illustrated in FIG. 24, the folded sheet bundle is discharged to the lower tray 203 by a lower paper discharging roller 83. When the folding unit passing sensor 323 detects the rear end of the sheet bundle, the folding plate 74 and the movable rear end fence 73 returns to their home positions, and the bundle carrying lower roller 72 is pressurized. Thus, the system returns to the state capable of carrying the sheet bundle and prepares for the next sheet. If the number and the size of the sheets in the next job are the same, the movable rear end fence 73 may stand by at the position illustrated in FIG. 20.

6.2. Alignment Condition

Figure 26:
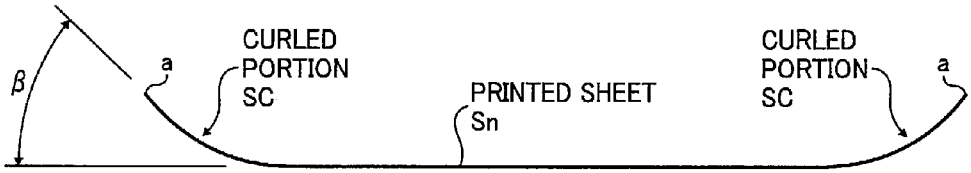
FIG. 26 is a sectional view of curled paper.

As illustrated in FIG. 6A, the sheets guided to the edge surface stitching tray F by the staple paper discharging roller 11 are sequentially stacked on the edge surface stitching tray F. In this case, the alignment in the longitudinal direction (sheet carrying direction) is performed for every sheet by the tapping roller 12, and the alignment in the lateral direction (the direction orthogonal to the sheet carrying direction, also referred to as the sheet width direction) is performed by the jogger fences 53. FIG. 26 is a sectional view of curled paper. Most sheets printed out from the image forming apparatus are somewhat curled because the sheet is carried by the roller and are heated and pressurized at the time of fixing an image to the sheet. Although a small degree of curl is acceptable to end users, the curl having an angle β of the curled portion SC as illustrated in FIG. 26 exceeding 45 degrees should be out of the acceptable range of users. Namely, to be acceptable as a product, the angle β of the curl should be around 45 degrees at worst.

Figure 27:
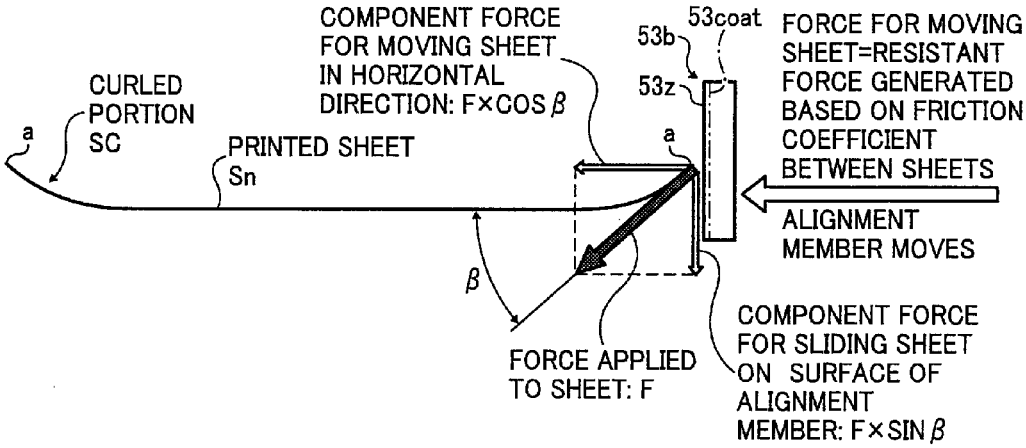
FIG. 27 is a diagram of the relationship of the forces at the time of aligning the curled sheets.
Figure 31A:
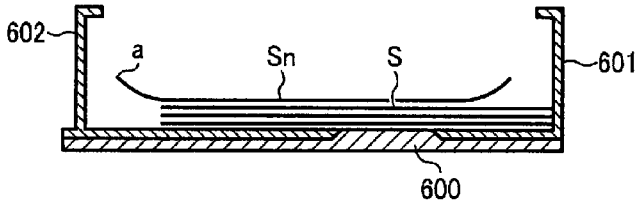
FIGS. 31A, 31B, and 31C are exemplary diagrams for explaining problems that arise when aligning sheets in a typical sheet aligning apparatus.
Figure 31B:
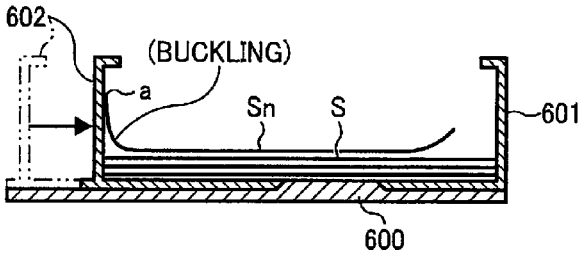
Figure 31C:
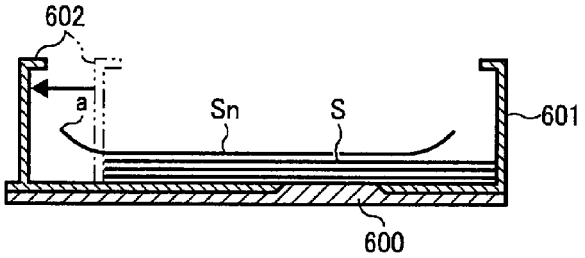

The operation for aligning such a sheet using a jogger has been described with reference to FIGS. 31A to 31C as a conventional example. FIG. 27 is a diagram of the relationship of forces applied when the edge surface a is in contact with the alignment surface 53*z* at the time of aligning the curled sheets. Referring to FIG. 27, the force for moving the sheet in the left direction in FIG. 27 is applied by pressing the end (edge surface a) of the curled portion SC with the right jogger 53*b*. The force for moving the sheet is obtained by subtracting the friction force between the uppermost sheet Sn and an underlying sheet from the force applied in the left direction. If the force transferred to the sheet Sn is represented as F, the component force for moving the sheet in the horizontal direction is represented as Fh, and the component force for sliding the alignment surface (pressurized surface) 53*z* of the jogger 53*b* is represented as Fv, following Equations can be obtained:

$$Fh=F*\cos$$

$$Fv=F*\sin$$

When the above Equations are applied to the acceptable angle of the curl, that is, 45 degrees, the relationship between the two component forces Fh and Fv is expressed by Equation (1):

$$Fh:Fv=1:1 \quad (1)$$

The component force Fh corresponds to resistance force FSf generated by the friction coefficient between the sheets attempting to move. To move the sheets, the relationship:

$$Fh>FSf \quad (2)$$

is required.

On the other hand, the component force Fv for sliding the edge surface a of the sheet Sn on the alignment surface 53*z* of the jogger 53*b* corresponds to resistance force FJf generated by the friction coefficient between the sheet and the jogger 53*b*. To move the sheet in the horizontal direction without sliding on the alignment surface 53*z* of the jogger 53*b*, the relationship:

$$Fv<FSf \quad (3)$$

is required. If the angle β of the curled portion is 45 degrees, the following relationship is required:

$$FSf<FJf \quad (4)$$

To make it simpler, the following relationship is required:

the friction coefficient between the sheets<the friction coefficient between the sheet and the alignment surface of the jogger (5)

In general, the friction coefficient of the sheet Sn is approximately 0.8 at maximum. If the friction coefficient between the edge surface a of the sheet Sn and the alignment surface 53*z* of the jogger 53 is set to be equal to or more than 0.8, the condition of Equation (5) can be satisfied.

In this example, the angle β of the curled portion SC is 45 degrees, which is the allowable limit. In the sheet post-processing apparatus PD in which the angle β of the curled portion SC is approximately 30 degrees at maximum, the friction coefficient between the edge surface a of the sheet and the jogger 53*b* may be set to be equal to or more than 0.46. Accordingly, the friction coefficient of the alignment surface 53*z* between the joggers 53*a* and 53*b* is set based on the maximum angle β of the curled portion SC in the sheet post-processing apparatus PD to be used. To obtain the friction coefficient, a coating material is selected. In this embodiment, urethane is used as the coating material. The urethane coating layer 53coat is formed on the surface of the alignment surface 53*z* to make the friction coefficient between the edge surface a and the alignment surface 53*z* equal to or more than 0.8. Moreover, the urethane coating layer 53coat is made to have conductivity. The conductivity can be obtained by mixing carbon powder into urethane, for example.

Figure 28A:
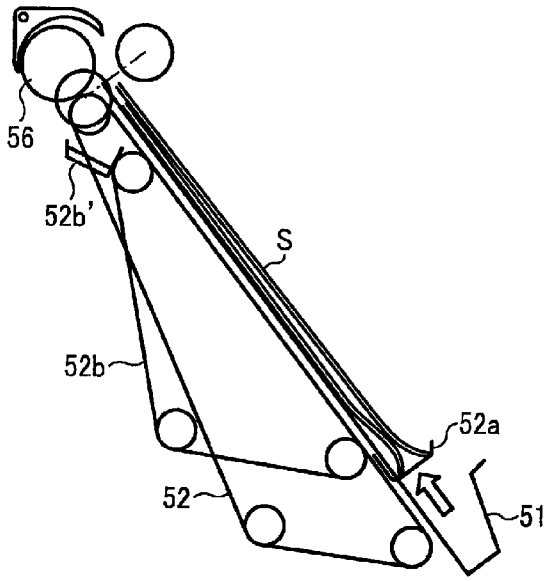
FIGS. 28A, 28B, and 28C are diagrams of the sheet bundle in a sheet bundle releasing mechanism when a sheet contact surface is not coated with urethane.
Figure 28B:
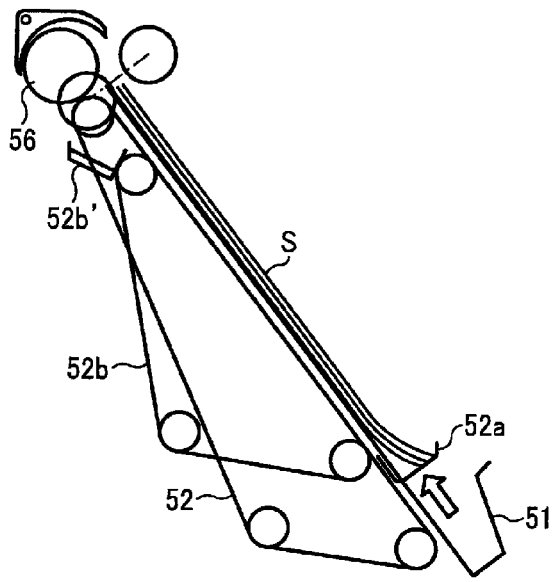
Figure 28C:
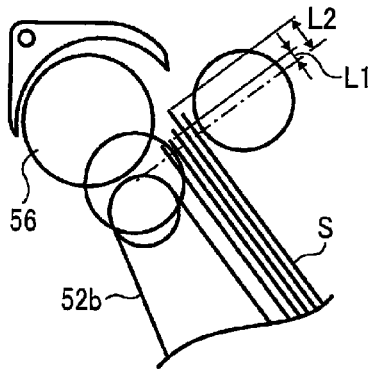
Figure 29:
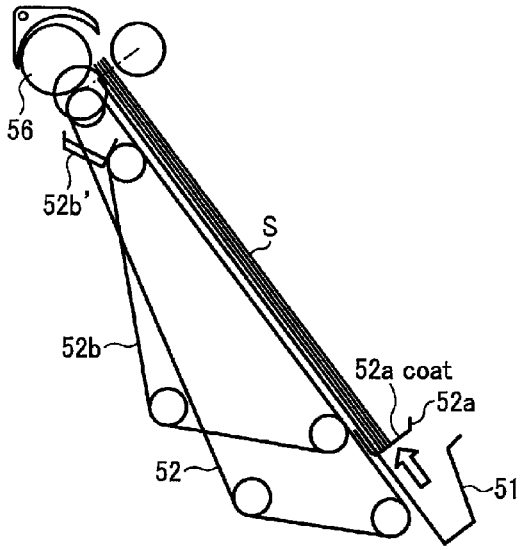
FIG. 29 is a diagram of the sheet bundle in the sheet bundle releasing mechanism when a sheet contact surface of a release claw is coated with urethane.
Figure 30:
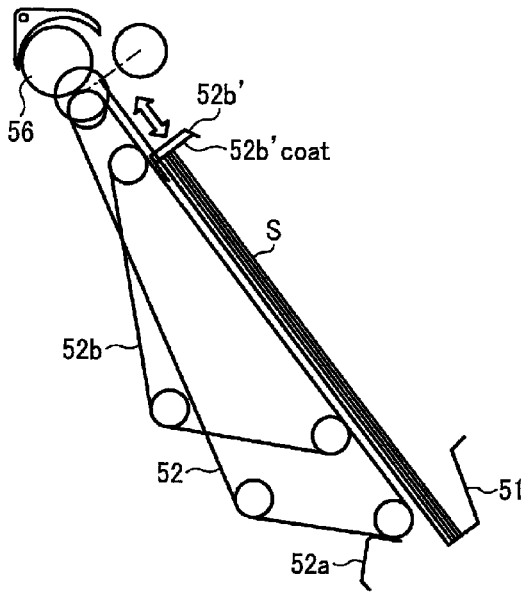
FIG. 30 is a diagram of the sheet bundle in the sheet bundle releasing mechanism when a sheet contact surface of a front end aligning claw is coated with urethane.

FIGS. 28A to 30 are diagrams of conditions of the sheet bundle in the sheet bundle releasing mechanism. Referring to FIGS. 28A, 28B, and 28C, the sheet contact surface is not coated with urethane. In FIGS. 29 and 30, the sheet contact surface of the release claw 52*a* is coated with urethane. FIGS. 28A and 28B are diagrams of a state where the sheet bundle S, of which a rear end is in contact with the rear end fences 51 to be aligned in the carrying direction, is carried by the release claw 52*a*. Referring to FIG. 28A, the rear end of each sheet that contacts the release claw 52*a* slide in the different direction. Referring to FIG. 28B, the rear ends of the sheets that contact the release claw 52*a* slide in the same direction. Such a curled state or a sliding state of the rear end causes a misalignment of the front end of the sheet by L1 or L2 from the reference point as illustrated in FIG. 28C. Accordingly, the alignment in the sheet carrying direction is incomplete and the binding operation and the like performed later is affected thereby.

Meanwhile, in FIG. 29, the contact surface 52*a*coat of the release belt 52 to which the rear end of the sheet contacts is coated with urethane, and the friction coefficient is set to the value described above. Consequently, the rear end of the sheet bundle S is prevented from sliding by the urethane coating of the contact surface 52*a*coat, and therefore, the sheet bundle can be carried while its rear end is aligned by the rear end fences 51.

In the examples illustrated in FIGS. 28A to 30, although the sheet bundle S is transported and released by the release belt 52 and the release claw 52*a*, the front end aligning drive belt 52*b* is also provided in addition to the release belt 52. The front end aligning drive belt 52*b* has a front end aligning claw 52*b*' that projects from the front end aligning drive belt 52*b* similar to the release claw 52*a*. The front end aligning drive belt 52*b* rotates in the direction opposite from that of the release belt 52, the front end aligning claw 52*b*' contacts the front end of the sheet bundle S as illustrated in FIG. 30 and presses the rear end of the sheet bundle S to the rear end fence 51 side to align the sheet bundle S therebetween. In this case, because the friction coefficient is set to the value described above by coating the sheet contact surface 52*b*'coat of the front end aligning claw 52*b*' with urethane, the front end of the sheet does not slide on the urethane coating of the sheet contact surface 52*b*'coat. Accordingly, as illustrated in FIG. 30, the alignment in the sheet carrying direction can be made with high accuracy. In this case, because the rear end fences 51 also functions as an alignment member, the sheet contact surfaces of the rear end fences 51 are desirably coated with urethane.

The present embodiment can provide the following effects.

1) Each alignment surface 53*z* of the joggers 53*a* and 53*b* that aligns the sheet is in a planar shape. When the curled end (edge surface a) of the sheet Sn contacts the alignment surface 53*z* and the sheet Sn is pressed, because the joggers 53*a* and 53*b* holds the edge surface a at the position contacting the alignment surface 53*z*, the edge surface a does not slide on the alignment surface 53*z* upon aligning the sheet. Therefore, reliable and highly accurate alignment is possible.

2) The sheet holding function (the function for preventing the sheet from sliding) on the alignment surface 53*z* is set based on the friction coefficient between the angle of the curled portion SC of the sheet Sn and the alignment surface 53*z*. Thus, the friction coefficient required for holding sheets can be calculated. Accordingly, the alignment surface 53*z* can be designed easily based on the friction coefficient.

3) The angle of the curled portion SC used at the setting of the friction coefficient is equal to or less than 45 degrees. Accordingly, the quality required as a product can be provided.

4) The sheet holding function of the alignment surface 53*z* can be obtained by coating. Accordingly, the required holding function can be obtained by only selecting the coating material.

5) The alignment surface 53*z* only requires to be coated with urethane that is a material having relatively high friction coefficient. Accordingly, the highly accurate alignment can be achieved without adding a special member or forming concavity and convexity on the alignment surface 53*z*.

6) The urethane coating 53coat has enough uniform film thickness and durability to be used for a carrying roller that generally requires high accuracy. The friction coefficient can be easily adjusted by compounding. Accordingly, the friction coefficient can be set that is most suitable for the edge surface a in terms of strength and durability.

7) The urethane coating 53coat has conductivity, and thus is capable of eliminating the effect of static electricity. As a result, even the sheet having static electricity can be aligned with high accuracy without sticking and floating.

8) The curled edge surface a of the sheet or the sheet bundle does not slide on the alignment surface 53*z*. Accordingly, a curled sheet or a soft sheet can be aligned on the planer alignment surface 53*z* with high accuracy.

9) The alignment surface 53*z* is formed of a plate or a molded material and required to have high planer characteristics. The coating of a film having a thickness of about 40 microns does not undermine the essential characteristics (flatness). Accordingly, the excellent alignment can be performed.

10) By providing the pressing Mylers 53*c* and 53*d* and a retractable pressurizing plate 110 to press the vicinity of the wall surface in the sheet bundle thickness direction, the alignment with even higher accuracy can be performed.

11) The urethane coating is performed on the release claw 52*a*, the front end aligning claw 52*b*', the sheet contact surfaces 52*a*coat and 52*b*'coat of the rear end fences 51, and the like to obtain a predetermined friction coefficient. Accordingly, the end of the sheet (edge surface of the sheet) does not slide on the contact surface, and therefore, highly accurate alignment in the sheet carrying direction can be performed.

In the above embodiment, the sheet corresponds to a sheet Sn, the sheet bundle corresponds to a reference character S, the alignment member corresponds to jogger fences 53, 53*a*, and 53*b*, the alignment surface corresponds to a reference numeral 53*z* and contact surfaces 52*a*coat and 52*b*'coat, the curled end corresponds to an edge surface a, the coating corresponds to a coating layer 53coat, the first lateral direction aligning unit corresponds to the joggers 53, 53*a*, and 53*b*, the first longitudinal direction aligning unit corresponds to rear end fences 51, 51*a*, and 51*b* and a front end aligning claw 52*b*, the first processing apparatus corresponds to a edge surface binding stapler S1, the bundle transferring unit corresponds to a release claw 52*a* and a release belt 52, the second processing apparatus corresponds to a saddle stitching stapler S2 or a folding plate 74 and a folding roller 81, the second lateral direction aligning unit corresponds to a saddle stitching upper jogger fence 250*a* and a saddle stitching lower jogger fence 250*b*, the second longitudinal direction aligning unit corresponds to a movable rear end fence 73 and a rear end tapping claw 251, the bundle carrying unit corresponds to the movable rear end fence 73, the pressing unit corresponds to a rear end pressing lever 110 or pressing Mylars 53*c* and 53*d*, the sheet processing apparatus corresponds to a sheet post-processing apparatus PD, and the image forming apparatus corresponds to a reference character PR.

Note that the prevent invention is not limited to the embodiment and all technical matters included in the technical idea described in the scope of the appended claims are included in the present invention.

In the present invention, an alignment member has a holding function that holds the end of a sheet at a position contacting an alignment surface when the alignment member performs pressing to align the sheet. Consequently, even with curl or soft paper, a sheet bundle aligned with high accuracy can be obtained by the pressing of a planer wall.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet aligning apparatus comprising:

an alignment surface formed in a planar shape and that presses an end of a sheet to move and align the sheet; and a holding unit that holds the end of the sheet at a position contacting the alignment surface in a state that a curled end of the sheet contacts the alignment surface and the sheet is thus pressed, wherein a friction coefficient of the alignment surface is adjusted to a desired value by providing a urethane coating on the alignment surface.

2. The sheet aligning apparatus according to claim 1, wherein the holding unit is configured to hold the end with friction force determined by an angle of a curled portion of the sheet and a friction coefficient of the alignment surface.

3. The sheet aligning apparatus according to claim 2, wherein the angle of the curled portion is equal to or less than 45 degrees.

4. The sheet aligning apparatus according to claim 1, wherein the urethane coating has electrical conductivity.

5. A sheet processing apparatus comprising:

an alignment tray for staking sheets thereon received from a carrying direction;

a first aligning device that includes a first lateral direction aligning unit that aligns sheets stacked on the alignment tray in a width direction orthogonal to a carrying direction and a first longitudinal direction aligning unit that aligns the sheets in the carrying direction thereby obtained a first-aligned sheet bundle;

a first processing device that performs predetermined processing to the first-aligned sheet bundle stacked on the alignment tray thereby obtaining a first-processed sheet bundle; and a first bundle transporting unit that transports the first-processed sheet bundle on the alignment tray downstream, wherein the first lateral direction aligning unit, the first longitudinal direction aligning unit, and the first bundle transporting unit have respective planar contact surfaces to which a curled end of a sheet contacts, and at least one contact surface of the first lateral direction aligning unit, the first longitudinal direction aligning unit, and the first bundle transporting unit comprises a holding unit that holds the curled end at a position contacting the end of the sheet, wherein a friction coefficient of the contact surfaces have been adjusted to a desired value by providing a urethane coating on the contact surfaces.

6. The sheet processing apparatus according to claim 5, further comprising:

a second processing device that is provided at a subsequent stage of the bundle transporting unit and performs predetermined processing to the first-processed sheet bundle transported by the bundle transporting unit thereby obtaining a second-processed sheet bundle;

a second aligning device that includes a second lateral direction aligning unit that aligns the first-processed sheet bundle in a width direction orthogonal to a carrying direction and a second longitudinal direction aligning unit that aligns the first-processed sheet bundle in the carrying direction before the second processing device performs the predetermined processing on the first-processed sheet bundle;

a second bundle transporting unit that transports the first-processed sheet bundle toward the second aligning device to make alignment, wherein the units have respective planar contact surfaces to which a curled end of a sheet contacts, and at least one contact surface of the units comprises a holding unit that holds the curled end at a position contacting the end of the sheet.

7. The sheet processing apparatus according to claim 6, wherein the second processing device is a saddle stitching device that binds a center of the first-processed sheet bundle.

8. The sheet processing apparatus according to claim 6, wherein the second processing device is a folding device that folds a center of the first-processed sheet bundle.

9. The sheet processing apparatus according to claim 5, wherein the holding unit is configured to hold the end with friction force determined by an angle of a curled portion of the sheet and a friction coefficient of the contact surface.

10. The sheet processing apparatus according to claim 9, wherein the angle of the curled portion is equal to or less than 45 degrees.

11. The sheet processing apparatus according to claim 5, wherein the urethane coating has electrical conductivity.

12. The sheet processing apparatus according to claim 5, wherein the first bundle transporting unit is an endless belt that moves forward or rearward against a sheet stacking surface of the alignment tray and has a contact portion that contacts the first-processed sheet bundle at a rear end in the carrying direction to transport the first-processed sheet bundle when moving forward.

13. The sheet processing apparatus according to claim 5, wherein the first processing device is a binding device that performs binding on the first-aligned sheet bundle.

14. The sheet processing apparatus according to claim 13, wherein the binding device is an end stitching device that binds an end of a sheet bundle or a saddle stitching device that binds a center of the sheet bundle.

15. The sheet processing apparatus according to claim 5, further comprising a pressing unit that presses the curled end.

16. An image forming apparatus comprising an image forming unit and a sheet processing apparatus that processes printed sheets received from the image forming unit, the sheet processing apparatus including:

an alignment tray for staking sheets thereon received from a carrying direction from the image forming unit;

a first aligning device that includes a first lateral direction aligning unit that aligns sheets stacked on the alignment tray in a width direction orthogonal to a carrying direction and a first longitudinal direction aligning unit that aligns the sheets in the carrying direction thereby obtained a first-aligned sheet bundle;

a first processing device that performs predetermined processing to the first-aligned sheet bundle stacked on the alignment tray thereby obtaining a first-processed sheet bundle; and a first bundle transporting unit that transports the first-processed sheet bundle on the alignment tray downstream, wherein the first lateral direction aligning unit, the first longitudinal direction aligning unit, and the first bundle transporting unit have respective planar contact surfaces to which a curled end of a sheet contacts, and at least one contact surface of the first lateral direction aligning unit, the first longitudinal direction aligning unit, and the first bundle transporting unit comprises a holding unit that holds the curled end at a position contacting the end of the sheet, wherein a friction coefficient of the contact surfaces have been adjusted to a desired value by providing a urethane coating on the contact surfaces.

* * * * *